US008430389B2

(12) United States Patent
Tokuma et al.

(10) Patent No.: US 8,430,389 B2
(45) Date of Patent: Apr. 30, 2013

(54) SHEET PROCESSING APPARATUS AND IMAGE FORMING APPARATUS

(75) Inventors: Naoto Tokuma, Abiko (JP); Yusuke Obuchi, Nagareyama (JP); Yuri Urano, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/107,709

(22) Filed: May 13, 2011

(65) Prior Publication Data

US 2011/0278783 A1 Nov. 17, 2011

(30) Foreign Application Priority Data

May 17, 2010 (JP) ..... 2010-113295
Apr. 21, 2011 (JP) ..... 2011-094648

(51) Int. Cl.
*B65H 37/04* (2006.01)

(52) U.S. Cl.
USPC ..... 270/37; 270/32; 270/45; 270/58.07; 270/58.08; 270/58.09

(58) Field of Classification Search ..... 270/32, 270/37, 45, 51, 58.07, 58.08, 58.09
See application file for complete search history.

(56) References Cited

U.S. PATENT DOCUMENTS

| | | | | |
|---|---|---|---|---|
| 7,374,160 | B2 * | 5/2008 | Doi | 270/37 |
| 7,562,866 | B2 | 7/2009 | Hayashi | |
| 7,832,715 | B2 * | 11/2010 | Iguchi et al. | 270/32 |
| 7,845,625 | B2 * | 12/2010 | Suzuki et al. | 270/37 |
| 2006/0027959 | A1 * | 2/2006 | Doi | 270/37 |
| 2007/0060459 | A1 | 3/2007 | Hayashi | |
| 2008/0315508 | A1 * | 12/2008 | Iguchi et al. | 271/226 |
| 2010/0258994 | A1 * | 10/2010 | Kikkawa et al. | 270/37 |
| 2011/0084436 | A1 * | 4/2011 | Shirakuma et al. | 270/37 |
| 2012/0146279 | A1 * | 6/2012 | Furuhashi et al. | 270/58.16 |

* cited by examiner

*Primary Examiner* — Leslie A Nicholson, III
(74) *Attorney, Agent, or Firm* — Canon USA, Inc., IP Division

(57) ABSTRACT

A sheet processing apparatus includes a staple processing portion and a sheet stacking portion on which a sheet is stacked and abutted. The sheet processing apparatus also includes a fold processing portion, a conveyance guide member, an end part processing portion to perform an end part process to the folded end part, and a controlling portion. After a stapling process is performed, the fold processing portion folds the sheet bundle in two to create a folded sheet bundle having a folded end part between a first surface and a second surface. The conveyance guide member guides the folded sheet bundle with the folded end part as a leading end while the first surface slides against the conveyance guide member. The controlling portion controls the positioning member such that the stapling position is moved, by a predetermined distance, to an area on the sheet bundle that will become the second surface.

15 Claims, 21 Drawing Sheets

SHEET PROCESSING APPARATUS AND IMAGE FORMING APPARATUS

BACKGROUND OF THE INVENTION

1. Field of the Invention

The present invention relates to a sheet processing apparatus that processes a sheet and an image forming apparatus provided therewith.

2. Description of the Related Art

Conventionally, for an image forming apparatus that forms an image in a sheet, there is well known an image forming apparatus provided with a sheet processing apparatus. The sheet processing apparatus is configured such that a folded booklet is formed by stapling of a bundle of sheets in which images are formed by the image forming apparatus. Hereinafter, the booklet is referred to as saddle-stitch bookbinding, and an apparatus that performs a saddle-stitch bookbinding process is referred to as a saddle-stitch bookbinding apparatus. The sheet processing apparatus sequentially receives the sheets in a tray, aligns the sheets with one another in the form of bundle, and performs stapling near the center in a conveying direction. A projecting member strikes the stapled part to push the stapled part into a nip of a pair of folding rollers, and the sheet bundle is folded while conveyed by the pair of folding rollers. (see U.S. Patent Application Publication No. 2007/060459 A1)

Action of the conventional sheet processing apparatus will be described with reference to FIGS. 2, 16, 17 and 18. In FIG. 2, only part necessary for the conventional technique is extracted and described.

As illustrated in FIG. 2, in a finisher (sheet processing apparatus) 500, a sheet stopper 805 sequentially receives and aligns plural sheets conveyed to an accommodation guide 803, and a stapler 820 staples a central part in the conveying direction. Then, a projecting member 830 strikes the stapled part of the sheet bundle to push the stapled part into a nip of a pair of first folding rollers 810*a* and 810*b*. The pair of first folding rollers 810*a* and 810*b* folds the sheet bundle in two while conveying the sheet bundle, and sequentially conveys the sheet bundle to a pair of second folding rollers 811*a* and 811*b* and a pair of third folding rollers 812*a* and 812*b*.

The sheet conveyance is tentatively stopped when a folding end part of the folded sheet bundle is conveyed a process position of a pair of press rollers 861. The pair of press rollers 861 moves along a fold line of the sheet in a width direction orthogonal to the sheet conveying direction to perform strengthening process to the folded part (see FIG. 16). Then, the folded sheet bundle is conveyed and discharged to a folded bundle tray 840.

In the conventional finisher, both the sheet stapling process and the striking and folding process are performed in the center of the sheet. That is, in stacking the sheets, the stapler 820 performs the stapling process to sheets P after the sheets P are sequentially stacked on the sheet stopper 805 that waits below by a half of a length L in the conveying direction of the sheet bundle P around the stapling position of the stapler 820, that is, L/2.

Then, both the sheet bundle P and the sheet stopper 805 move by a distance L1 from the center of the stapler 820 to the nip center of the pair of first folding rollers 810 such that the nip center of the pair of first folding rollers 810 and the stapled part of the sheet P are matched with each other (see FIG. 16).

For example, for the reason an apparatus width is decreased, sometimes the pair of first folding rollers 810, the pair of second folding rollers 811, and the pair of third folding rollers 812 are not linearly disposed, but configured as a curved conveying path as illustrated in FIGS. 2 and 16. That is, the pair of second folding rollers 811 is located slightly above the pair of first folding rollers 810, the pair of third folding rollers 812 is located below the pairs of first and second folding rollers 810 and 811, and the nip direction of the pair of second folding rollers 811 is oriented downward to the left. Totally, in FIG. 16, the nip of the pair of press rollers 861 is located below the nip of the pair of first folding rollers 810.

However, the following state is generated when the sheet bundle P in which the stapling process and the striking and folding process are performed to the central part thereof is conveyed through the bent conveying path. That is, the leading end of the sheet bundle is oriented downward by an upper guide 814*a* in the upper guide 814*a* and a lower guide 814*b* of a conveying guide portion 814 between the pair of folding rollers 811 and 812. Therefore, in the sheet bundle P, an outside (upper side) stretches by a conveying resistance from the upper guide 814*a* while an inside (lower side) sags.

When the stretch state and the sag state are generated in the sheet bundle P, a staple S performed in parallel to the sheet bundle P is oriented upward.

Then, the sheet bundle P is conveyed to the pair of third folding rollers 812, the sheet bundle P is conveyed to the pair of press rollers 861 and a pair of crushing rollers 862 while the staple S is oriented upward as illustrated in FIG. 17, and the conveyance of the sheet bundle P is tentatively stopped.

The sheet bundle P is conveyed to the pair of press rollers 861 and the pair of crushing rollers 862 while deviated in a front-back direction of the apparatus (a front-depth direction of FIG. 2), and the conveyance of the sheet bundle P is tentatively stopped. Then, the pair of press rollers 861 and the pair of crushing rollers 862 move in a direction of an arrow a of FIG. 18, and an press process and a crushing process are performed to the leading end of the folded part near the staple S of the sheet bundle P. The pair of additionally folding rollers 861 applies a force in a direction of an arrow Fp of FIG. 17 and the pair of additionally folding rollers 861 can swing in a direction of an arrow Rp of FIG. 17. The pair of crushing rollers 862 applies a force in a direction of an arrow t of FIG. 17, and can swing in a direction of an arrow Rt.

In the conventional finisher, because the press process and the crushing process are performed while the staple S is oriented upward, the staple S is oriented upward in the final deliverable, and the quality of the saddle-stitch sheet bundle P is finally degraded. That is, the sheet bundle is conveyed through the curved conveying path to deform the leading end of the folded part of the sheet bundle, and the press process and the crushing process are performed while the staple S is oriented upward. Therefore, the staple S is deviated to generate the final deliverable in which the quality is degraded.

The present invention provides a sheet processing apparatus that can solve the problems such as the reduction of productivity, the cost increase and degradation of accuracy of sheet position control, and an image forming apparatus provided with the sheet processing apparatus.

SUMMARY OF THE INVENTION

According to the present invention, a sheet processing apparatus includes a sheet stacking portion on which a conveyed sheet is sequentially stacked as part of a number of sheets of a sheet bundle stacked on the sheet stacking portion; a positioning member against which an end of the sheet conveyed to the sheet stacking portion is abutted for a positioning of the sheet bundle stacked on the sheet stacking portion; a staple processing portion which performs a stapling process to the sheet bundle stacked on the sheet stacking portion, the positioning member is movable for adjusting a stapling position on the sheet bundle where the staple processing portion performs the stapling process; a fold processing portion which folds the sheet bundle in two to create a folded sheet bundle after the stapling process is performed; a conveyance guide member which guides the folded sheet bundle being conveyed from the fold processing portion with a folded end part as a leading end while one of two surfaces of the folded sheet bundle slides on the conveyance guide member; an end part processing portion which performs an end part process to the folded end part of the folded sheet bundle guided by the conveyance guide member; and a controlling portion which controls a movement of the positioning member, when the end part process is performed by the end part processing portion, such that the stapling process is performed while the stapling position is previously moved, by a predetermined distance, to an opposite area side of the sheet bundle opposite to an area that becomes the one of two surfaces of the folded sheet bundle when the sheet bundle is folded in two.

Further features of the present invention will become apparent from the following description of exemplary embodiments with reference to the attached drawings.

DESCRIPTION OF THE EMBODIMENTS

First Embodiment

Figure 1:
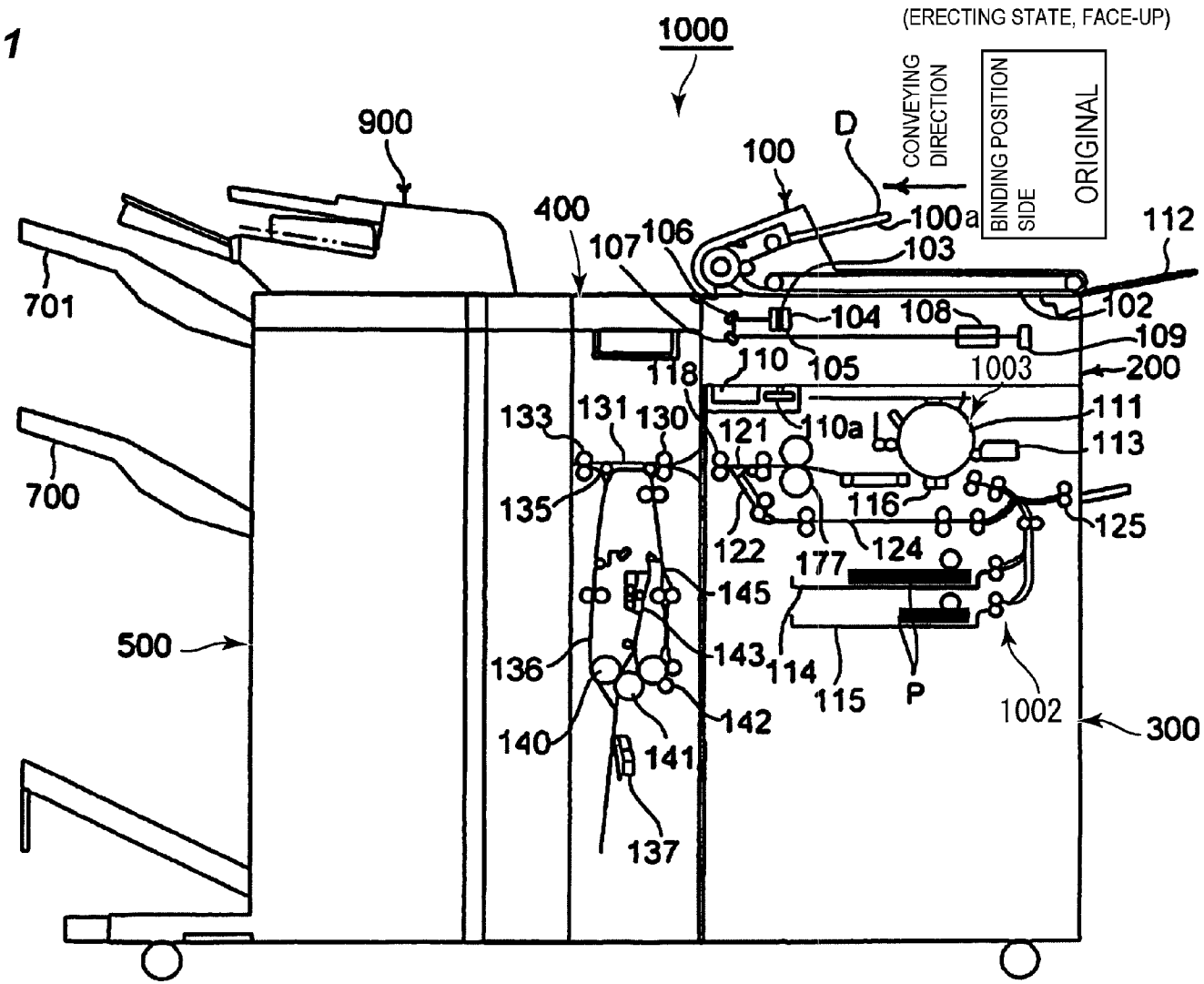
FIG. 1 is a sectional view illustrating a copying machine as an example of an image forming apparatus according to an embodiment provided with a finisher that is a sheet processing apparatus.
Figure 2:
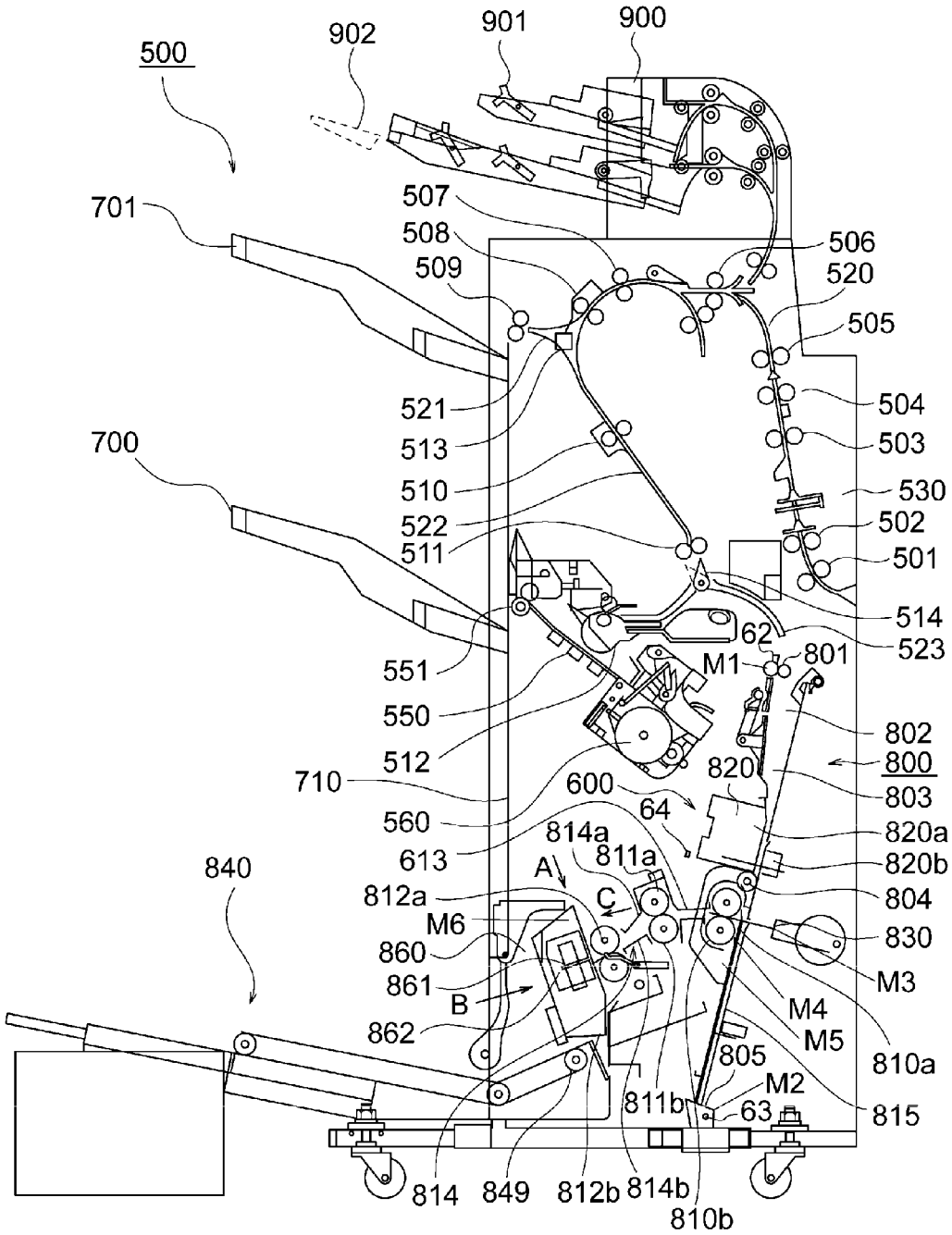
FIG. 2 is a sectional view illustrating a finisher according to a first embodiment.

Exemplary embodiments of the present invention will be described in detail below with reference to the drawings. FIG. 1 is a sectional view illustrating a copying machine as an example of an image forming apparatus according to an embodiment provided with a finisher that is a sheet processing apparatus. FIG. 2 is a sectional view illustrating a finisher according to a first embodiment.

Figure 7:
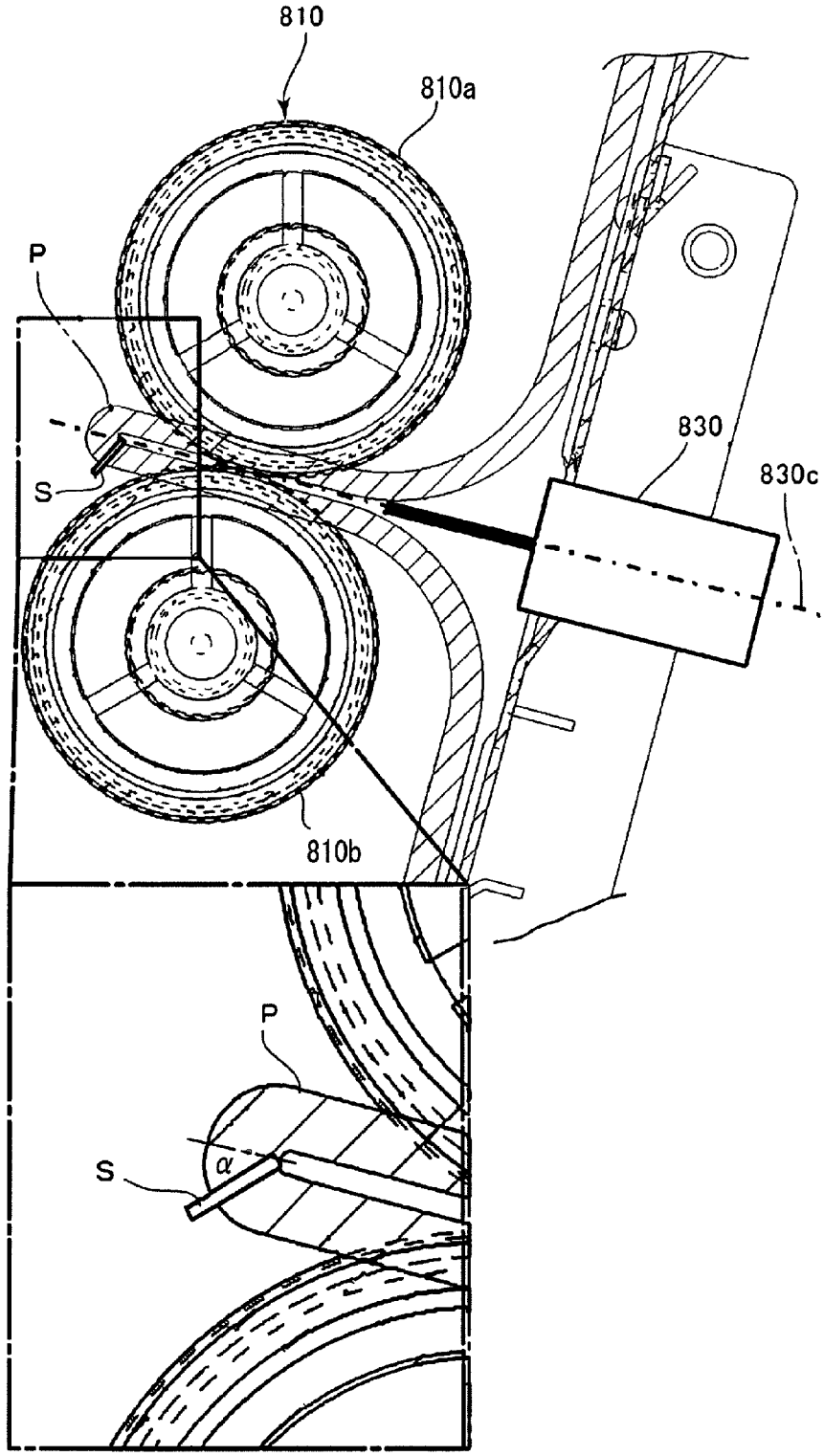
FIG. 7 is an explanatory view illustrating the action of the finisher of the first embodiment.

In an example, one of the surfaces of the folded sheet bundle, which is delivered from the fold processing portion while the folded end part is set to the leading position, and the end part process can be performed without degrading the quality of the final deliverable. The increase of the apparatus width can be suppressed to implement the miniaturization by the conveying guide portion that guides the folded sheet bundle while curved. The end part process is performed while the position of the staple is properly located in consideration of the resistance of the conveyance guide member, which allows the implementation of the sheet processing apparatus in which the quality of the final deliverable is not degraded. In another example, a finisher controlling portion controls a position of a sheet stopper 805 (FIG. 5) such that a stapling process is performed while a position where a stapler 820 performs stapling to a sheet bundle P is previously moved by a displacement amount ($\alpha$) onto a side of the surface opposite to one of surfaces of the folded sheet bundle P guided by an upper guide 814*a* (FIG. 8B). Therefore, an increase of an apparatus width is suppressed by curving a conveying path through which the folded sheet bundle P is conveyed from a pair of first folding rollers 810 (FIG. 7) to the fold-line press unit, and an end part process can be performed while a position of a staple is properly located with an inexpensive configuration. Therefore, the problems such as degradation of quality of a final deliverable can be solved.

(Image Forming Apparatus)

As illustrated in FIG. 1, a copying machine 1000 that is an image forming apparatus includes an original feeding portion 100, an image reader portion 200, a printer portion 300, a folding processing portion 400, a finisher 500 that is a sheet processing apparatus, and an inserter 900 that inserts a sheet. The copying machine 1000 can be equipped with the folding processing portion 400 and the inserter 900 as an optional extra.

An original D is set onto a tray 100*a* of the original feeding portion 100 in a face-up state (a surface in which the image is formed is oriented upward). It is assumed that the stapling position of the original is a left end part of the original. The originals set onto the tray 100*a* are sequentially conveyed one by one from a front page by the original feeding portion 100 while a left direction, that is, the stapling position is set to the leading position. The original is conveyed left to right on a platen glass 102 after passing through a curved path, and the original is discharged onto a discharge tray 112. At this point, a scanner unit 104 is stopped at a predetermined original read position.

The scanner unit 104 reads the image of the original that passes left to right on the scanner unit 104. The original is irradiated with a lamp 103 of the scanner unit 104 while passing through the platen glass 102. Light reflected from the original is guided to an image sensor 109 through mirrors 105, 106 and 107 and a lens 108.

Predetermined image processing is performed to image data of the original read by the image sensor 109, and the image data is transmitted to an exposure controlling portion 110. The exposure controlling portion 110 outputs a laser beam according to an image signal. A photosensitive drum 111 is irradiated with the laser beam while scanned with the laser beam by a polygon mirror 110*a*. An electrostatic latent image is formed on the photosensitive drum 111 according to the laser beam with which the photosensitive drum 111 scanned.

The electrostatic latent image formed on the photosensitive drum 111 is developed by a development device 113 and visualized as a toner image. On the other hand, the sheet P is conveyed to a transfer portion 116 from one of cassettes 114 and 115, a manual feed portion 125, and a duplex conveying path 124. The visualized toner image is transferred to the sheet P at the transfer portion 116. The toner image of the transferred sheet P is fixed by a fixing portion 177. The photosensitive drum 111 and the development device 113 constitute an image forming portion that forms the image in the sheet.

The sheet having passed through the fixing portion 177 is tentatively guided to a path 122 by a changeover member 121. After a rear end of the sheet P passes through the changeover member 121, the sheet is switched back and guided to a discharge roller 118 by the changeover member 121. The sheet is discharged from the printer portion 300 by the discharge roller 118. Thus, the sheet P is discharged from the printer portion 300 while the surface in which the toner image is formed is oriented downward (face down). This action is called "reverse discharge".

When the sheet P is discharged to the outside of the apparatus in the face-down state, the image forming process can sequentially be performed from the front page. For example, the page numbers can be sequenced when the image forming process is performed using the original feeding portion 100 or when the image forming process is performed to the image data from a computer 204 (see FIG. 12).

When the image forming process is performed to both sides of the sheet P, the printer portion 300 directly guides the sheet P from the fixing portion 177 to the discharge roller 118. Immediately after the rear end of the sheet P passes through the changeover member 121, the sheet P is switched back and guided to the duplex conveying path 124 by the changeover member 121.

(Folding Processing Portion 400)

The folding processing portion 400 includes a conveying path 131 that introduces the sheet P discharged from the printer portion 300 and guides the sheet P onto the side of the finisher 500, and pairs of conveying rollers 130 and 133 are provided on the conveying path 131. A changeover member 135 is provided near the pair of conveying rollers 133, and the changeover member 135 guides the sheet P conveyed by the pair of conveying rollers 130 to the folding path 136 or the side of the finisher 500.

When the folding process is performed to the sheet P, the changeover member 135 is changed onto the side of a folding path 136 to guide the sheet P to the folding path 136. Then, the leading end of the sheet P guided to the folding path 136 is abutted on a stopper 137, and a loop is formed by abutting the leading end of the sheet P, whereby the loop is gradually folded by folding rollers 140 and 141. A loop formed by abutting the folded part on an upper stopper 143 is further folded by folding rollers 141 and 142, whereby the sheet P is folded into Z-fold.

The Z-folded sheet P is delivered to the conveying path 131 through a conveying path 145, and the sheet P is discharged to the finisher 500 on the downstream side by the pair of conveying rollers 133. On the other hand, when the folding process is not performed, the changeover member 135 is changed onto the finisher side, and the sheet P discharged from the printer portion 300 is directly delivered to the finisher 500 through the conveying path 131.

(Finisher 500)

The finisher 500 constitutes the sheet processing apparatus that performs the bookbinding by folding the bundle of sheets in which the images are formed by the image forming portion, and performs the stapling process of stapling the rear end side of the sheet bundle P, a bookbinding process and the like. The finisher 500 integrally includes a staple portion 600 that staples the sheets and a saddle-stitch bookbinding portion 800 that folds the sheet bundle in two to perform the bookbinding process. The finisher 500 aligns the plural sheets P conveyed from the printer portion 300 through the folding processing portion 400 and performs a sheet process. Examples of the sheet process include the process of bundling the sheets into one sheet bundle P, the stapling process of stapling the sheet bundle P, a sort process, and a non-sort process.

As illustrated in FIG. 2, the finisher 500 includes a conveying path 520 that takes the sheet P conveyed through the folding processing portion 400 in the finisher 500. In the conveying path 520, pairs of conveying rollers 502 to 508 are sequentially provided from a pair of inlet rollers 501 toward the downstream side in the sheet conveying direction.

A punch unit 530 is provided between the pair of conveying rollers 502 and the pair of conveying rollers 503. The punch unit 530 is configured to punch a hole in the rear end part of the sheet as required (perform a punching process).

A changeover member 513 provided at a dead end of the conveying path 520 changes between an upper discharge path 521 and a lower discharge path 522, which are connected to the downstream side. In the upper discharge path 521, an upper discharge roller 509 guides the sheet to a sample tray 701. On the other hand, pairs of conveying rollers 510, 511, and 512 are provided in the lower discharge path 522. The pairs of conveying rollers 510, 511, and 512 discharge the sheet to a processing tray 550.

Figure 12:
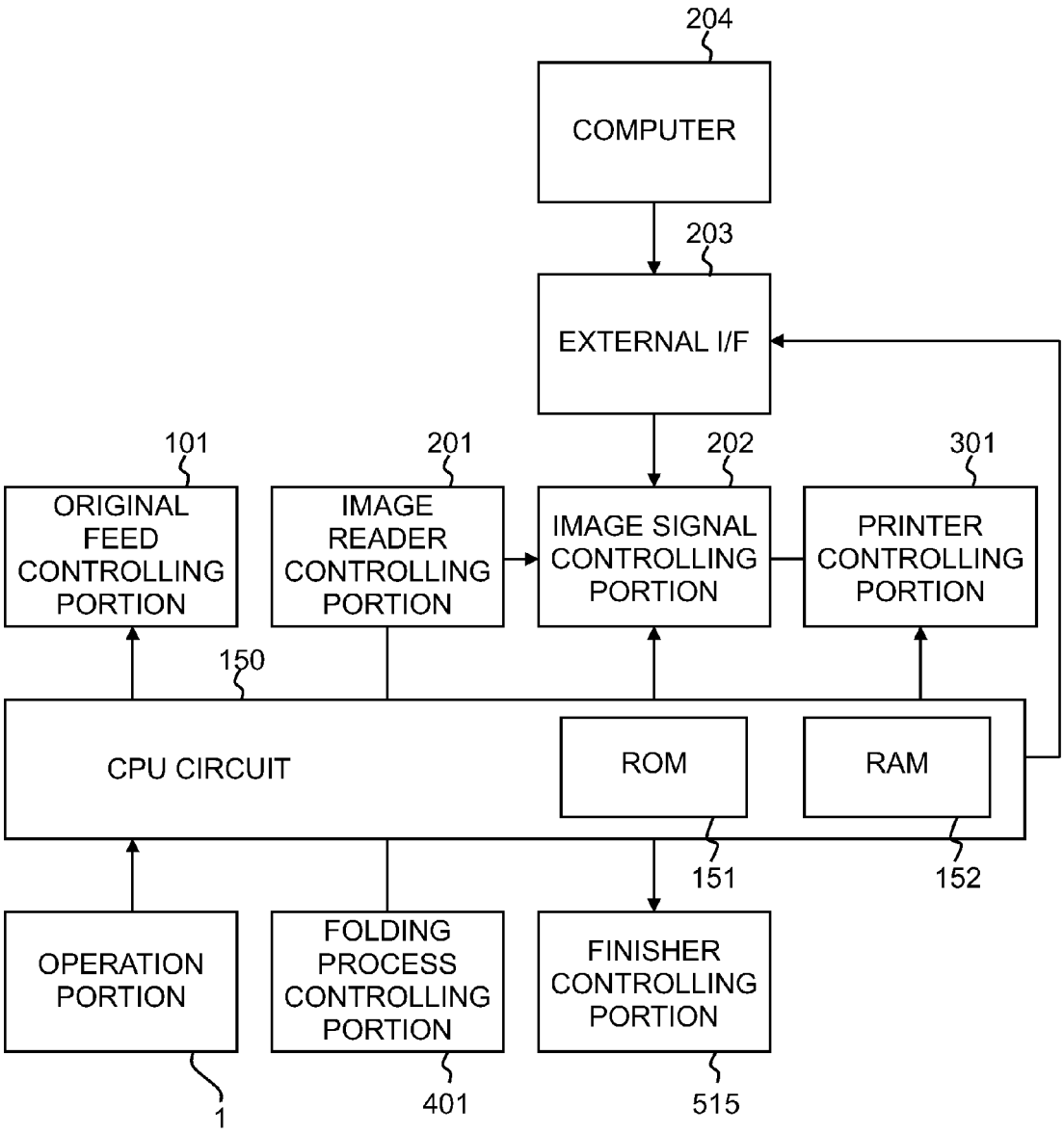
FIG. 12 is a control block diagram illustrating a copying machine of the first embodiment.

The sheets P discharged to the processing tray 550 are stacked in the form of bundle while sequentially aligned, and the sort process or the stapling process is performed to the sheet P according to a setting from an operation portion 1 (see FIG. 12). The processed sheet bundle P is selectively discharged to a stack tray 700 and the sample tray 701 by a pair of bundle discharge rollers 551.

The stapling process is performed by the stapler 560. The stapler 560 moves in the width direction (direction orthogonal to the sheet conveying direction) of the sheet to perform the stapling at any position of the sheet bundle P. The stack tray 700 and the sample tray 701 are lifted and lowered along a main body of the finisher 500. The sample tray 701 on the upper side receives the sheet from the upper discharge path 521 and the processing tray 550. The stack tray 700 on the lower side receives the sheet from the processing tray 550. A large amount of sheets can be stacked on the stack tray 700 and the sample tray. The rear ends of the stacked sheets are received and aligned by a rear end guide 710 extending in a vertical direction.

The sheet is delivered to the saddle-stitch bookbinding portion 800 through a saddle discharge path 523 by changing the changeover member 514, provided in the middle of the lower discharge path 522, to a broken-line position. In such cases, the sheet is transferred to a pair of saddle inlet rollers 801, a carry-in port of the sheet is selected by a changeover member 802 that is operated by a solenoid according to a sheet size, and the sheet is conveyed in the accommodation guide 803 of the saddle-stitch bookbinding portion 800. The accommodation guide 803 constitutes a sheet stacking portion that sequentially stacks the conveyed sheet.

The sheet conveyed in the accommodation guide 803 is conveyed by an intermediate roller 804 until the leading end of the sheet is abutted against a sheet stopper 805 that can move vertically. The sheet stopper 805 constitutes a positioning member for a positioning of the sheet bundle stacked on the accommodation guide 803, and is movable for adjusting a stapling position where a stapler (staple processing portion) 820 performs the stapling to the sheet bundle. The pair of saddle inlet rollers 801 and the intermediate roller 804 is driven by a motor M1.

The stapler 820 is disposed in the middle of the accommodation guide 803. The stapler 820 includes a driver 820*a* and an anvil 820*b*, which are disposed across the accommodation guide 803 from each other, the driver 820*a* projects a staple, and the anvil 820*b* bends the projected staple. The stapler 820 constitutes the staple processing portion that performs the stapling process to the sheet bundle stacked on the accommodation guide 803 that is the sheet stacking portion.

At this point, when the sheet is conveyed in, the sheet stopper 805 is controlled such that the central part in the sheet conveying direction is stopped at the position where the stapler 820 performs the stapling. The sheet stopper 805 is vertically movable by a motor M2, and the position of the sheet stopper 805 can be changed according to the sheet size.

The pair of first folding rollers 810 (810*a* and 810*b*) that is a pair of folding rollers that folds the sheet in two while sandwiching the sheet bundle therebetween is provided downstream of the stapler 820. A projecting member 830 that projects the sheet bundle stacked on the accommodation guide 803 toward the pair of first folding rollers 810 is provided opposite the nip of the pair of first folding rollers 810. The pair of first folding rollers 810 and the projecting member 830 constitutes the fold processing portion, and the folding processing portion performs the folding process such that the position where the stapler 820 performs the stapling to the sheet bundle becomes a fold leading end part (folded end part). A position where the projecting member 830 retracts from the accommodation guide 803 is set to a home position. The projecting member 830 is configured such that a motor M3 projects the projecting member 830 toward the sheet bundle P to push the sheet bundle in the nip of the pair of first folding rollers 810.

The sheet bundle can be pushed in the nip of the pair of folding rollers 810*a* and 810*b* that is the fold processing portion by projecting the projecting member 830 toward the sheet bundle. The projecting member 830 is configured to return to the home position after pushing the sheet bundle.

On the other hand, a spring (not illustrated) applies a pressure enough to form the fold line in the sheet bundle between the pair of first folding rollers 810*a* and 810*b* in which the sheet bundle is pushed, whereby the fold line is formed in the sheet bundle when the sheet bundle passes through the pair of first folding rollers 810*a* and 810*b*. The sheet bundle in which the fold line is formed is discharged to the folded bundle tray 840 through the pair of second folding rollers 811*a* and 811*b* and the pair of third folding rollers 812*a* and 812*b*.

A pressure enough to convey and stop the sheet bundle in which the fold line is formed is also applied to the pair of second folding rollers 811*a* and 811*b* and the pair of third folding rollers 812*a* and 812*b*. The pair of first folding rollers 810*a* and 810*b*, the pair of second folding rollers 811*a* and 811*b* and the pair of third folding rollers 812*a* and 812*b* are rotated at a constant speed by the motor M4.

Figure 3:
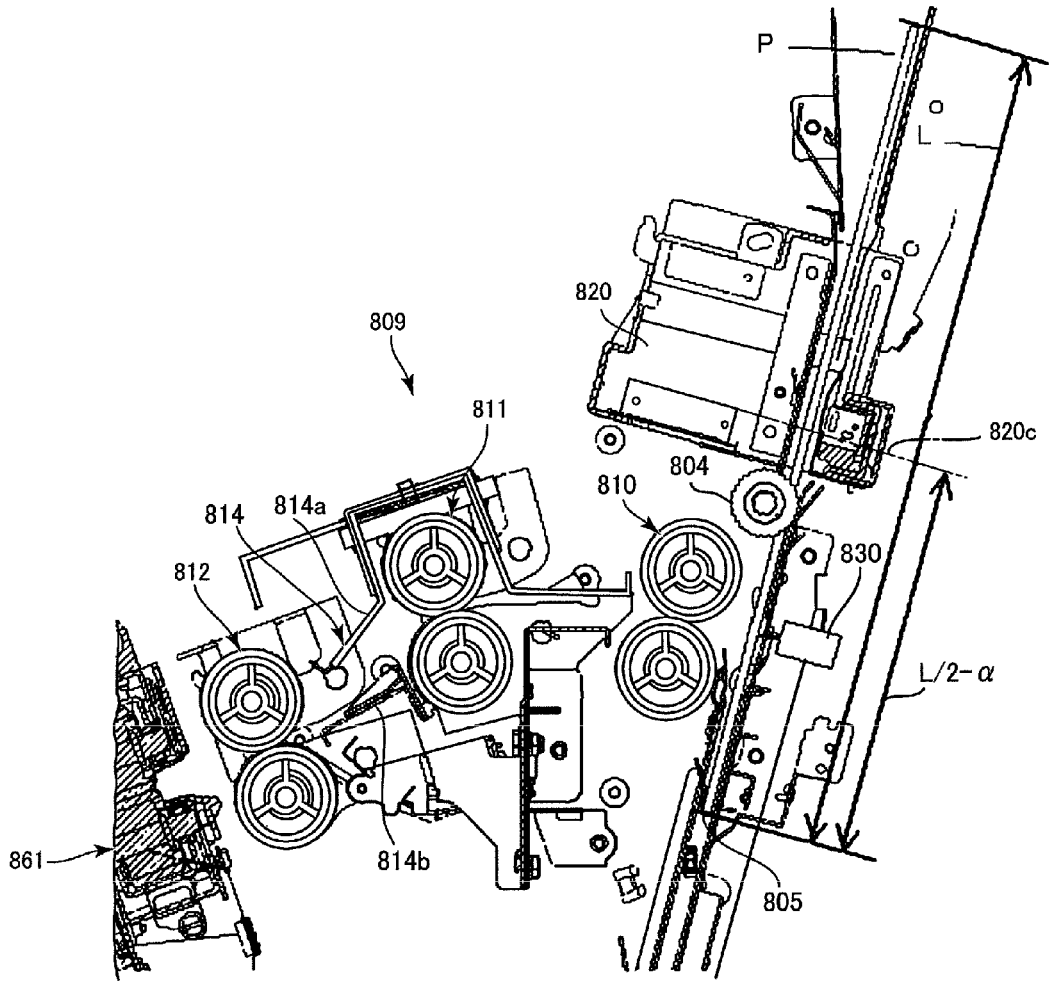
FIG. 3 is a configuration diagram illustrating the finisher of the first embodiment.

In FIG. 2, a conveying guide 613 connects the pair of first folding rollers 810*a* and 810*b* and the pair of second folding rollers 811*a* and 811*b*. A conveying guide portion 814 includes an upper guide 814*a* and a lower guide 814*b* to connect the pair of second folding rollers 811*a* and 811*b* and the pair of third folding rollers 812*a* and 812*b*. The upper guide 814*a* constitutes the conveyance guide member that guides the folded sheet bundle P in the curved manner while one of surfaces of the folded sheet bundle P, which is delivered from the fold processing portion including the pair of first folding rollers 810 and the projecting member 830 while the folded end part is set to the leading position, slides on the conveyance guide member. In FIG. 3, a conveyance guide portion 809 includes the pairs of second and third folding rollers 811 and 812 that are disposed in the curved state from the pair of first folding rollers 810.

A pair of aligning plates 815 includes a surface that is projected to the accommodation guide 803 while surrounding outer circumferential surfaces of the pair of folding rollers 810*a* and 810*b*, and the pair of aligning plates 815 aligns the sheets accommodated in the accommodation guide 803. The pair of aligning plates 815 is driven by a motor M5, and the pair of aligning plates 815 moves in a sandwiching direction with respect to the sheets to position the sheets in the width direction.

A fold-line press unit 860 is provided on downstream of the pair of third folding rollers 812*a* and 812*b* to strengthen the fold line of the sheet bundle. The fold-line press unit 860 constitutes the end part processing portion. The end part processing portion performs an end part process (fold enhancing process) to the folding leading end part (folded end part) of the folded sheet bundle (P) guided by the upper guide 814*a* that is the conveying guide member. The fold-line press unit 860 that is the end part processing portion includes the pair of press rollers 861 and the pair of crushing rollers 862, and the fold-line press unit 860 is driven by a motor M6 for driving the fold-line press unit.

As described above, the projecting member 830 is projected upward from the stacking surface side of the accommodation guide 803 to push the sheet bundle in the nip of the pair of first folding rollers 810. The fold line is formed in the sheet bundle by the fold-line press unit 860, and the sheet bundle is discharged to the folded bundle tray 840 while oriented downward. When the sheet bundle is discharged to the folded bundle tray 840 while oriented downward, the sheet bundle can be discharged while a stable posture is maintained, thereby obtaining a good stacking property. The sheet bundle to which the folding process and the end part process are already performed can be stacked well while the compact apparatus is implemented by the conveying guide portion 814 constituting the curved path.

Figure 13:
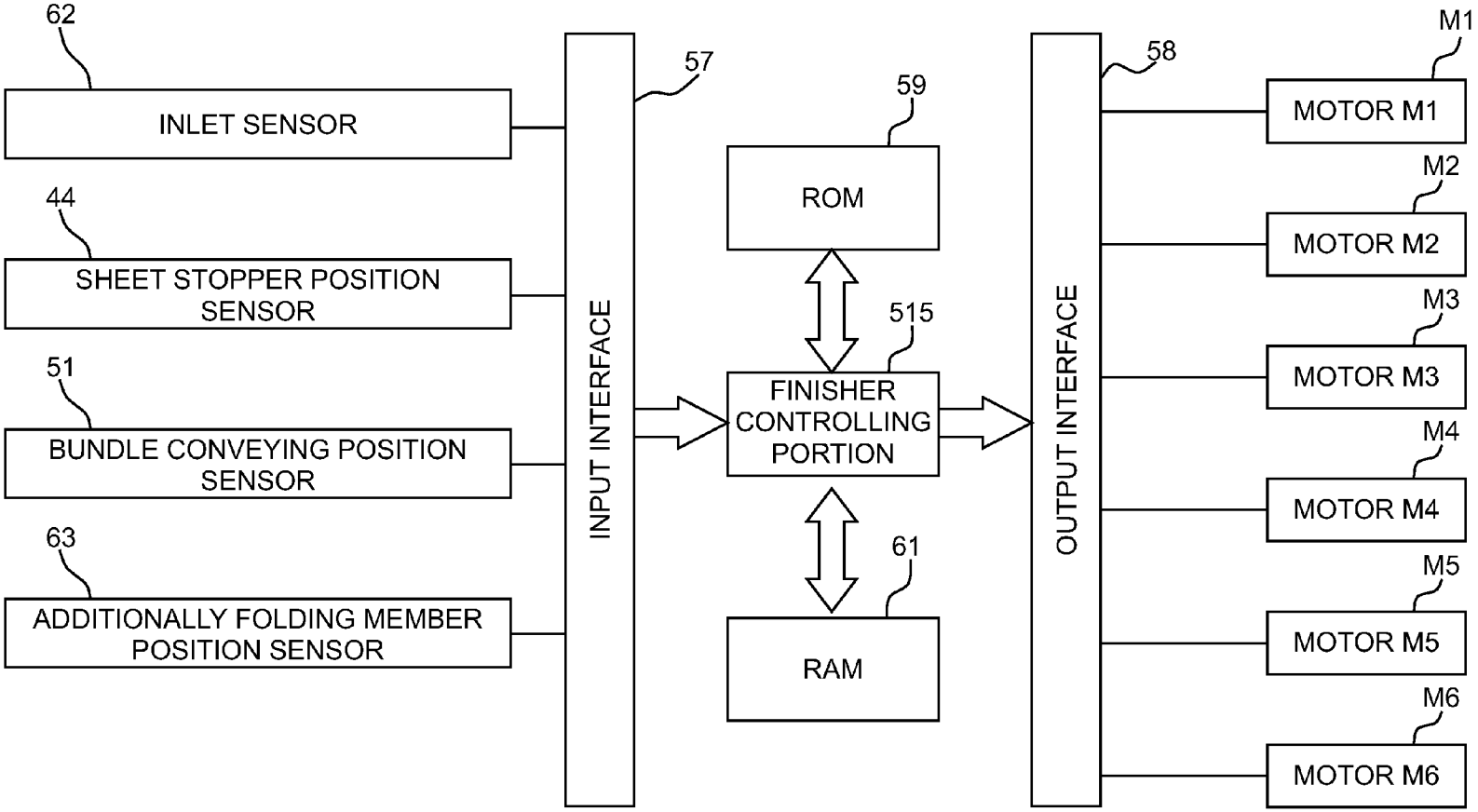
FIG. 13 is a control block diagram illustrating the finisher of the first embodiment.

A control system of the first embodiment will be described with reference to FIGS. 12 and 13. FIG. 12 is a control block diagram illustrating the copying machine 1000 of the first embodiment, and FIG. 13 is a control block diagram illustrating the finisher 500 of the first embodiment.

A CPU circuit 150 controls an original feed controlling portion 101, an image reader controlling portion 201, an image signal controlling portion 202, a printer controlling portion 301, and a folding process controlling portion 401 according to a control program stored in a ROM 151 and the setting of the operation portion 1. The CPU circuit 150 also controls a finisher controlling portion 515 and an external I/F 203 according to the control program stored in the ROM 151 and the setting of the operation portion 1.

The original feed controlling portion 101 controls the document feed portion 100, the image reader controlling portion 201 controls the image reader portion 200, the printer controlling portion 301 controls the printer portion 300, and the folding process controlling portion 401 controls the folding processing portion 400. The finisher controlling portion 515 controls action of the staple portion 600, the saddle-stitch bookbinding portion 800, and the inserter 900 in the finisher 500.

The finisher controlling portion 515 constitutes the controlling portion that controls the position of the sheet stopper 805 when the stapler 820 performs the stapling process. The finisher controlling portion 515 controls the position of the sheet stopper 805 such that the stapling process is performed while the stapling position, where the stapler 820 performs the stapling on the sheet bundle, is previously moved by a predetermined distance onto an area side of the surface (lower surface in FIG. 8) opposite to an area that becomes one (upper surface in FIG. 8) of two surfaces of the folded sheet bundle when the sheet bundle is folded in two. The one of two surfaces of the folded sheet bundle is guided by the upper guide 814*a*. The predetermined distance means a displacement amount α with respect to a folding position.

In the first embodiment, the displacement amount α that is the predetermined distance is set according to the number of sheets of the sheet bundle P stacked on the accommodation guide 803. The displacement amount α that is the predetermined distance can be set according to a thickness of the sheet of the sheet bundle P stacked on the accommodation guide 803. Instead, the displacement amount α can arbitrarily be set by the user operation of the operation portion 1. In such cases, in performing the end part process with the fold-line press unit 860, a position of a staple S in the folding leading end part (folding end part) of the sheet bundle can properly be set according to a kind of the sheet in which the image is formed.

The operation portion 1 includes plural keys for setting various functions concerning the image formation and a display portion on which a setting state is displayed. The operation portion 1 outputs a key signal corresponding to each key operated by the user to the CPU circuit 150 and displays corresponding information on the display portion (not illustrated) based on a signal from the CPU circuit 150.

A RAM 152 is used as an area for temporarily retaining the control data or as a working area for computation involved with the control. The external I/F 203 is an interface between the copying machine 1000 and an external computer 204. The external I/F 203 expands the print data from the computer 204 into a bit-mapped image and outputs the bit-mapped image as the image data to the image signal controlling portion 202.

The image of the original read by the image sensor (not illustrated) is output to the image signal controlling portion 202 from the image reader controlling portion 201, and the printer controlling portion 301 outputs the image data from the image signal controlling portion 202 to an exposure controlling portion (not illustrated).

As illustrated in FIG. 13, the finisher controlling portion 515 receives signals through an input interface 57 from an inlet sensor 62, a sheet stopper position sensor 44, a bundle conveying position sensor 51 and an press member position sensor 63. The inlet sensor 62 detects the sheet conveyed by the pair of inlet rollers 501, and the sheet stopper position sensor 44 detects the position of the sheet stopper 805. The bundle conveying position sensor 51 (see FIG. 9A) detects the position of the sheet bundle P, and the press member position sensor 63 detects the position of the pair of press rollers 861.

The finisher controlling portion 515 controls the drive of each of the motors M1 to M6 through an output interface 58 according to a control program stored in a ROM 59. A RAM 61 connected to the finisher controlling portion 515 is used as an area for temporarily retaining the control data or as a working area for computation involved with the control.

The motor M1 drives the saddle inlet roller 801 and the intermediate roller 804, and the motor M2 vertically moves the sheet stopper 805. The motor M3 operates the projecting member 830 so as to project the projecting member 830 from the home position where the projecting member 830 retracts from the accommodation guide 803 toward the accommodated sheet bundle P. The motor M4 rotates the pair of folding rollers 810, the pair of second folding rollers 811 and the pair of third folding rollers 812 at a constant speed. The motor M5 moves the pair of aligning plates 815 in the sandwiching direction with respect to the sheet to position the sheet in the width direction. The motor M6 drives the fold-line press unit 860 including the pair of press rollers 861 and the pair of crushing rollers 862.

(Saddle-Stitch Bookbinding Portion 800)

Figure 4:
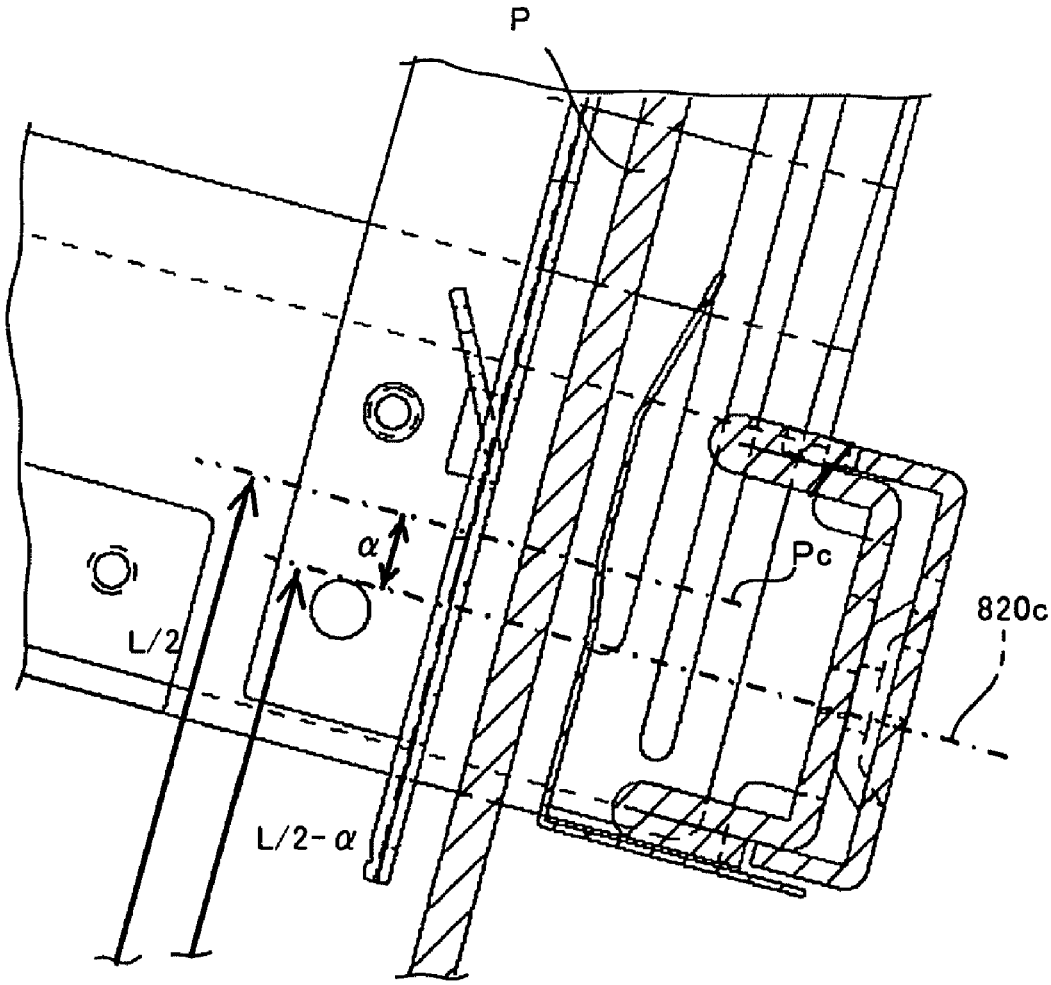
FIG. 4 is an explanatory view illustrating action of the finisher of the first embodiment.

Outlines of a configuration and action of the saddle-stitch bookbinding portion 800 that is the sheet stacking apparatus will be described below with reference to FIGS. 1 to 11 and a flowchart of FIG. 14. FIG. 4 is an enlarged view of the stapler 820 of FIG. 3.

Hereinafter, the process of folding the sheet bundle P by the pair of first folding rollers 810 (810*a* and 810*b*) and the projecting member 830 is referred to as a folding process. The process of strengthening the fold line of the sheet bundle P, to which the folding process is already performed, by the pair of press rollers 861 is referred to as a press process. The process of squaring the sheet bundle P, to which the folding process is performed, by crushing the leading end (folded leading end part) of the folded part with the pair of crushing rollers 862 is referred to as the crushing process. The action of the press process and the action of the crushing process are similar to those of FIG. 18. The pair of additionally folding rollers 861 applies a force in a direction of an arrow Fp of FIG. 11 and the pair of additionally folding rollers 861 can swing in a direction of an arrow Rp of FIG. 11. The pair of crushing rollers 862 applies a force in a direction of an arrow t of FIG. 11, and can swing in a direction of an arrow Rt.

In the first embodiment, the saddle-stitch bookbinding portion 800 is incorporated as the apparatus having the processing function in the finisher 500. The finisher 500 receives information on the sheet P to be printed from the printer portion 300 of the copying machine 1000 (sheet size discriminating process, Step S1 of FIG. 14). As illustrated in FIG. 3, based on the information on the length L in the conveying direction of the sheets (bundle) P, the finisher controlling portion 515 moves the sheet stopper 805 to the position where a staple position 820*c* is located below the sheet bundle by −α with respect to the middle position (L/2) in the conveying direction of the sheet bundle, and causes the sheet stopper 805 to wait (S2 of FIG. 14). The middle position in the conveying direction of the sheet bundle is a half of the length L in the conveying direction of the sheet bundle P stacked on the accommodation guide 803. The "displacement amount α" is described in detail later.

The finisher controlling portion 515 operates the changeover member 514 located in the middle of the lower discharge path 522 so as to change the sheet P to the right of FIG. 2, whereby the sheet P conveyed in the finisher 500 is guided to the saddle discharge path 523 and then the saddle-stitch bookbinding portion 800. The sheet P is conveyed into the accommodation guide 803 by the saddle inlet roller 801 and the intermediate roller 804, and the sheet is abutted on the sheet stopper 805 to end the conveyance. Thus, the sheet P is sequentially stacked based on the sheet stopper 805 (sheet accommodation operation) (S3 of FIG. 14).

Figure 14:
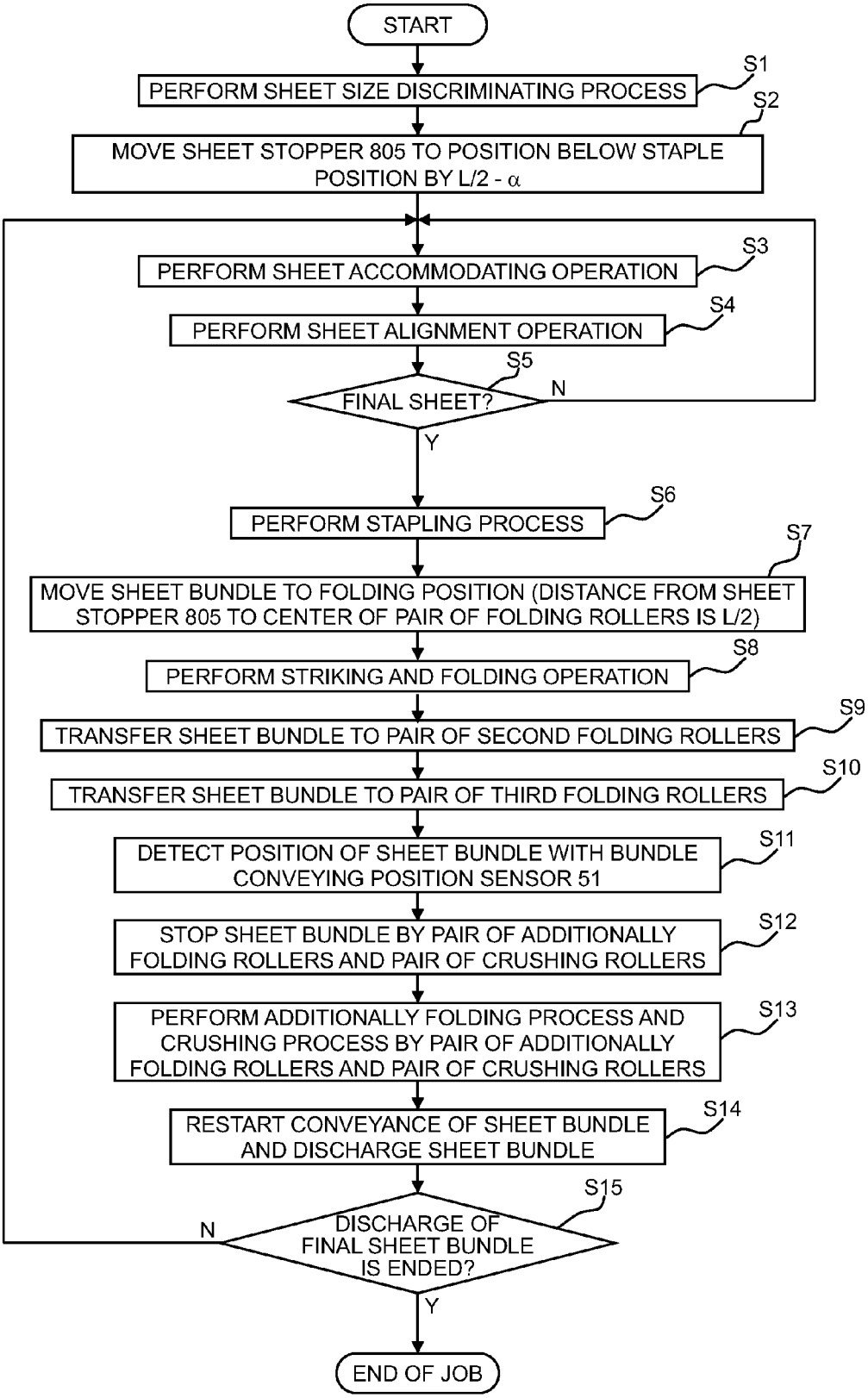
FIG. 14 is a flowchart illustrating the action of the finisher of the first embodiment.

The pair of aligning plates 815 aligns the width direction orthogonal to the sheet conveying direction under the control of the finisher controlling portion 515 (sheet alignment operation) (S4 of FIG. 14). At this point, the sheet stopper 805 waits below the staple position 820*c* of the stapler 820 by not L/2 but L/2−α as illustrated in FIG. 3. The stapling process is performed under the control of the finisher controlling portion 515. As illustrated in FIG. 4, the sheet bundle P is stapled at the position of L/2−α from the sheet stopper 805, which is deviated downward from the position of L/2 (sheet center Pc) by α (stapling process) (S6 of FIG. 14). A determination whether the sheet is the final sheet is made between Steps S4 and S6, Step S3 is repeated until the determination that the sheet is the final sheet is made, and the flow goes to Step S6 when the determination that the sheet is the final sheet is made.

Figure 5:
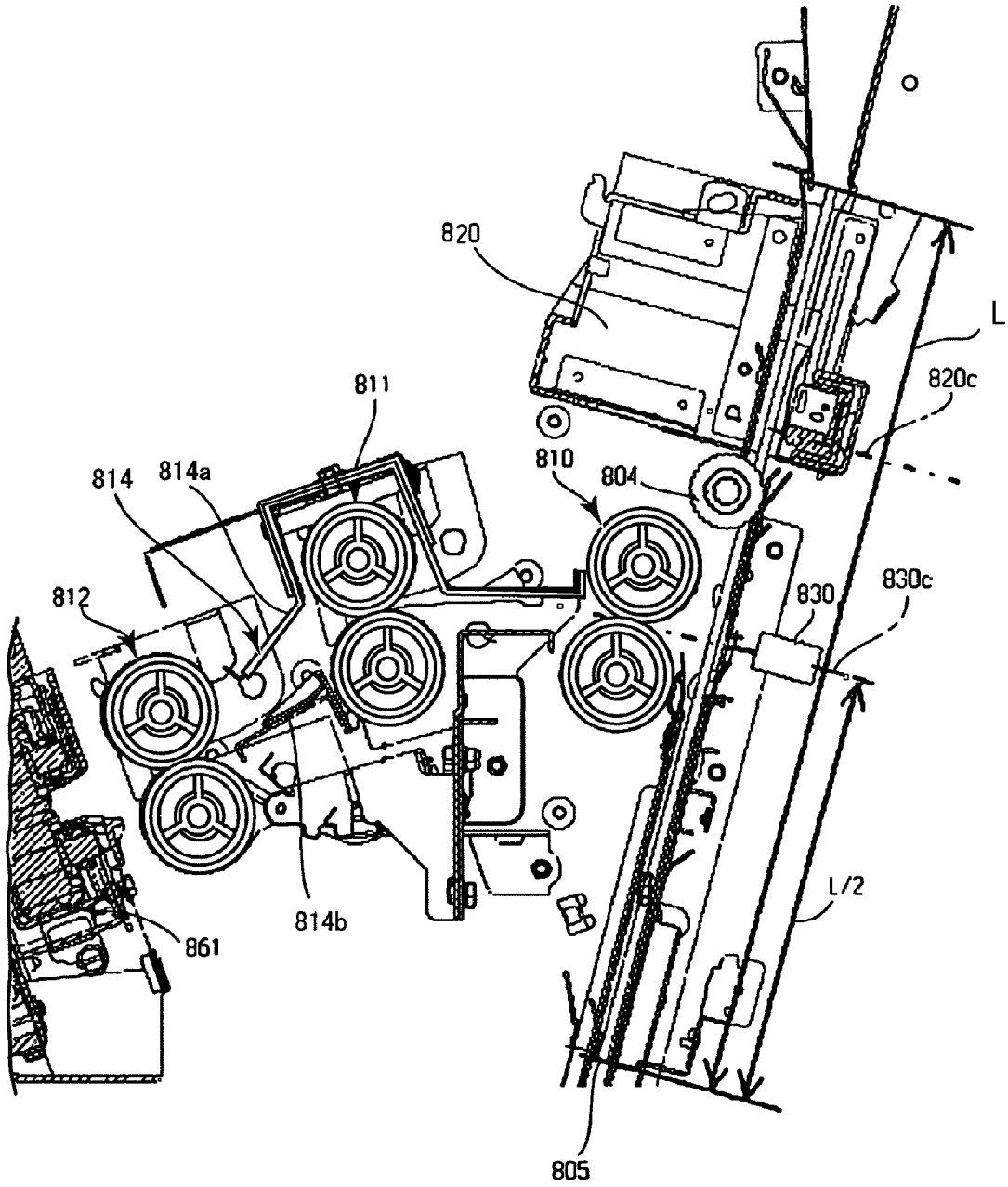
FIG. 5 is an explanatory view illustrating the action of the finisher of the first embodiment.
Figure 6:
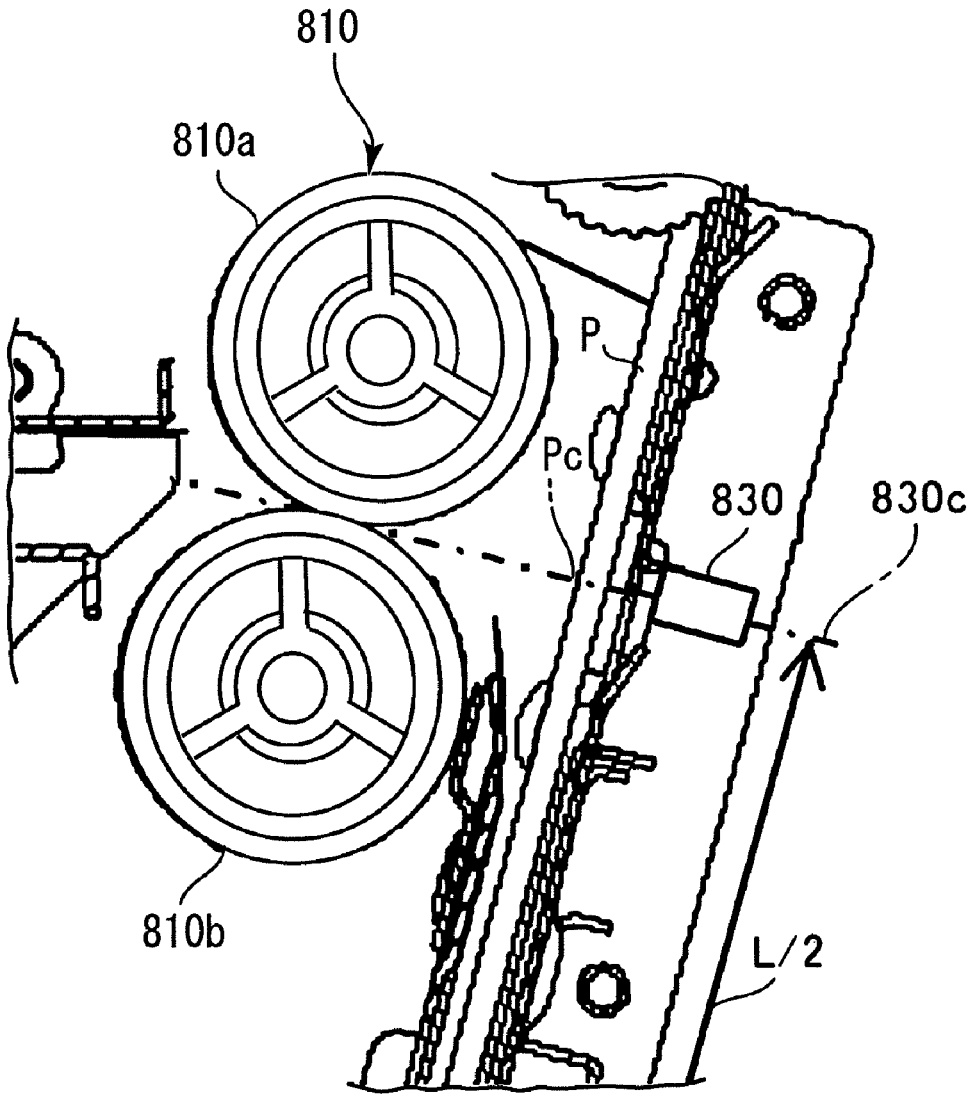
FIG. 6 is an explanatory view illustrating the action of the finisher of the first embodiment.

As illustrated in FIG. 5, the finisher controlling portion 515 lowers the sheet stopper 805, whereby the sheet bundle P is lowered to the striking and folding position (folding position) (S7 of FIG. 14). At this point, as illustrated in FIGS. 5 and 6, the sheet stopper 805 is located below the nip center of the pair of first folding rollers 810, that is, the projecting part center 830*c* that is the center of the projecting member 830 by L/2, and the projecting part center 830*c* and the center Pc of the sheet bundle P are aligned with each other. That is, the sheet bundle P is moved to the striking and folding position (folding position), whereby the distance from the sheet stopper 805 to the center (nip) of the pair of first folding rollers 810 becomes L/2.

The projecting member 830 projects the sheet bundle P at this position, and the pair of first folding rollers conveys the sheet bundle while folded in two (projecting and folding operation) (S8 of FIG. 14). At this point, as illustrated in FIG. 7, the position to which the folding process is performed in the sheet bundle P is deviated from the position of the staple S by α until the nip of the pair of first folding rollers 810 immediately after the striking and folding. Thus, the stapling process is performed at the position of L/2−α from the sheet stopper 805 to strike and fold the sheet bundle P at the position of L/2, which allows the deviation to be generated by α between the position to which the folding process is performed in the sheet bundle P and the staple S.

Then, the sheet bundle P is conveyed and transferred to the pair of second folding rollers 811 (811*a* and 811*b*) (S9 of FIG. 14). At this point, because the nip direction of the pair of second folding rollers 811 is oriented to slightly lower right (see FIG. 5), the leading end of the sheet bundle P is oriented downward by the conveying guide portion 814 (see FIG. 2) that is disposed in substantially parallel to the nip direction. That is, the conveying direction of the sheet bundle P is biased downward by the upper guide (conveyance guide member) 814*a* of the conveying guide portion 814, the upper side of the sheet bundle P receives a conveying resistance, and the leading end of the sheet bundle P is oriented downward. Therefore, as illustrated in FIG. 8A, the outside (upper side) of the sheet bundle P stretches while the inside (lower side) sags.

Figure 8A:
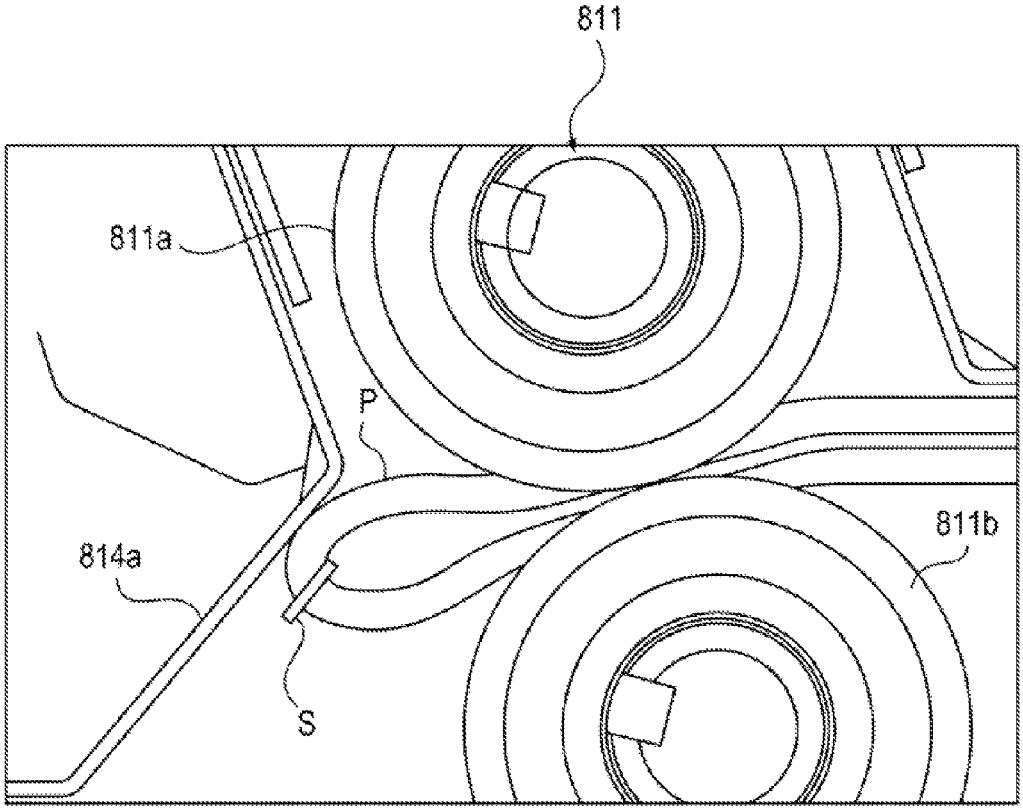
FIG. 8A is an explanatory view illustrating the action of the finisher of the first embodiment.
Figure 8B:
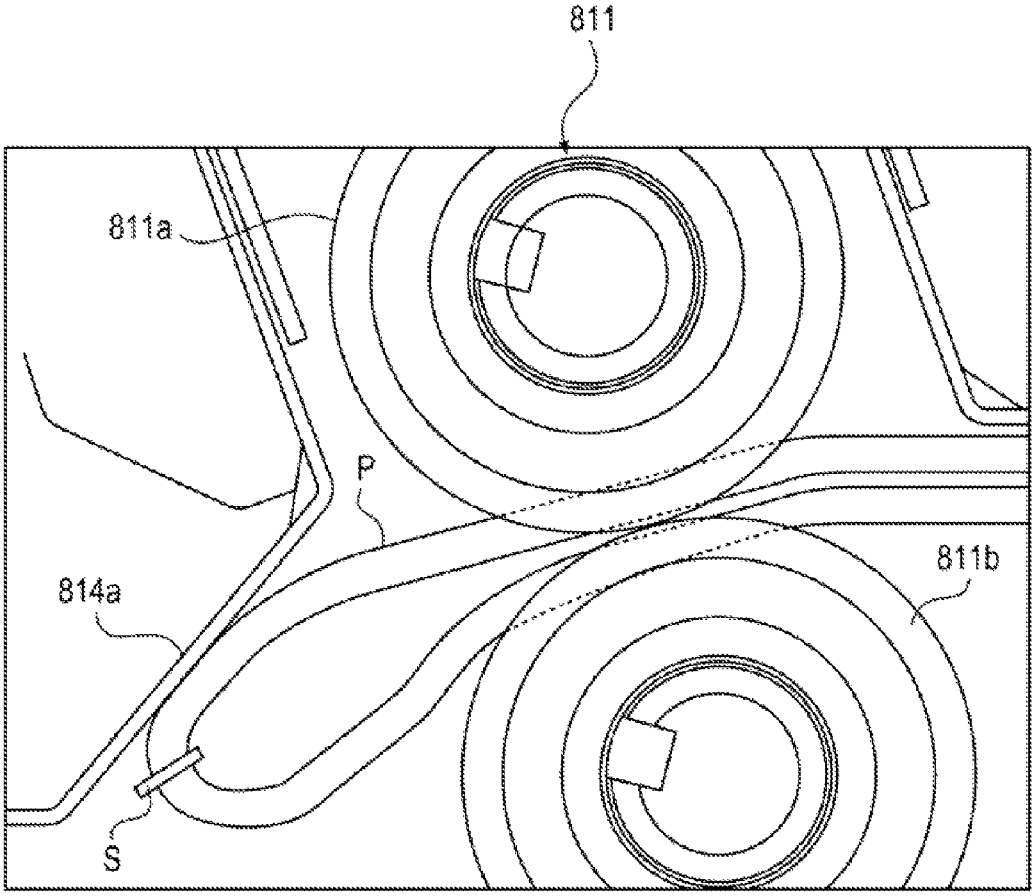
FIG. 8B is an explanatory view illustrating the action of the finisher of the first embodiment.

When the stretch state and the sag state are generated in the sheet bundle P, the staple S deviated originally from the center as illustrated in FIG. 8A in the leading end of the folded part of the sheet bundle comes close to the neighborhood of the center as illustrated in FIG. 8B.

Figure 9A:
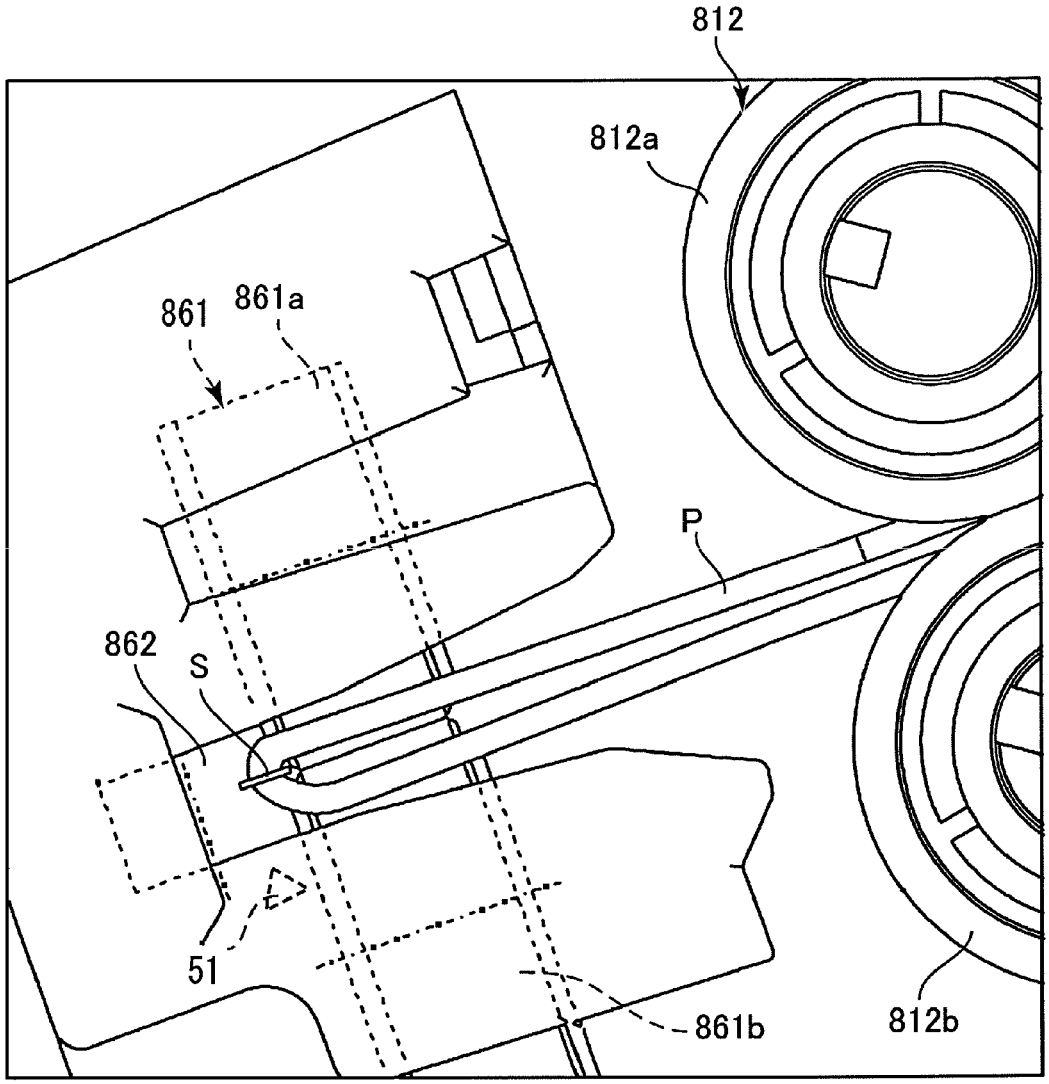
FIG. 9A is an explanatory view illustrating the action of the finisher of the first embodiment.

The sheet bundle P is projected and transferred to the pair of third folding rollers 812 (812*a* and 812*b*) (S10 of FIG. 14). Then, the finisher controlling portion 515 stops the motor M4, which rotates the pair of first folding rollers 810, the pair of second folding rollers 811 and the pair of third folding rollers 812 at a constant speed, at the region of the pair of press rollers 861, thereby tentatively stopping the conveyance of the sheet bundle P. At this point, the finisher controlling portion 515 causes the bundle conveying position sensor 51 (see FIG. 9A) to detect the position of the sheet bundle P (S11 of FIG. 14). The finisher controlling portion 515 stops the sheet bundle P at the regions of the pair of press rollers 861 (861*a* and 861*b*) and the pair of crushing rollers 862 (S12 of FIG. 14). At this point, as illustrated in FIG. 9A, the staple S is located in the center of the leading end, while the stretch state and sag state still remain in the leading end of the folded part (folded end part) of the sheet bundle P.

Figure 18:
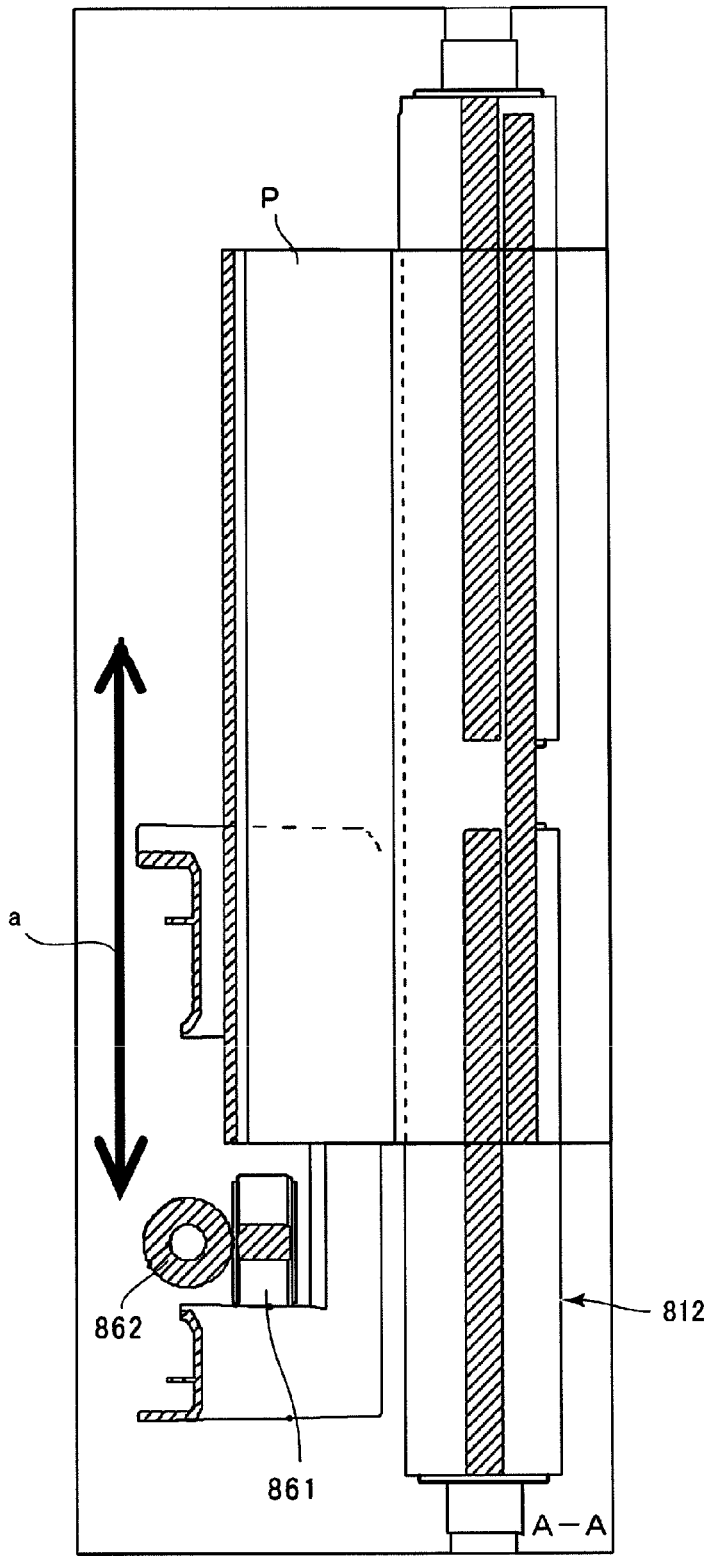
FIG. 18 PRIOR ART
FIG. 18 is an explanatory view illustrating the action of the conventional finisher.

The finisher controlling portion 515 drives the motor M6 for driving the fold-line press unit to move the pair of press rollers 861 and the pair of crushing rollers 862 in a direction of an arrow a of FIG. 18, and the press process and the crushing process are performed (S13 of FIG. 14).

Figure 9B:
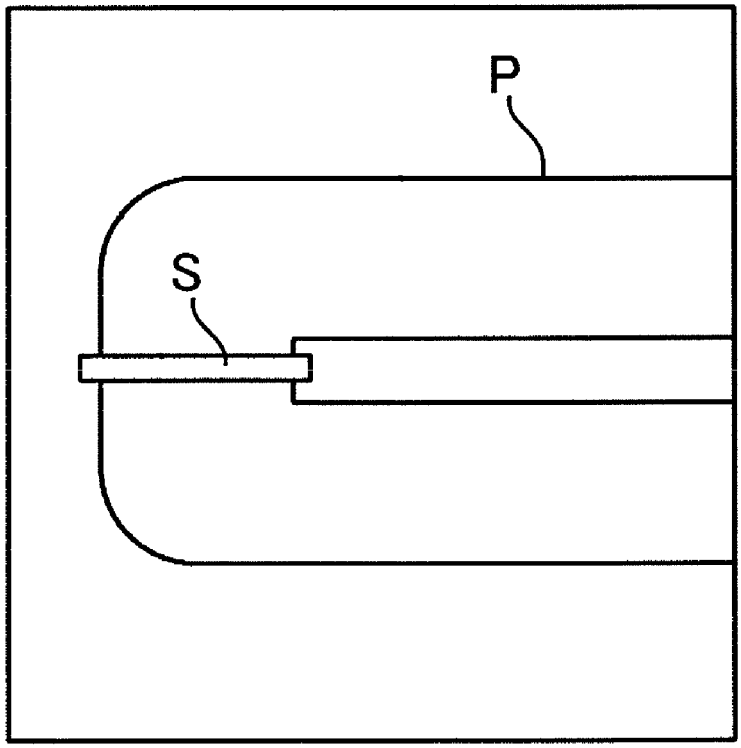
FIG. 9B is an explanatory view illustrating the action of the finisher of the first embodiment.

When the press process and the crushing process are performed while the staple S is located in the central part of the thickness of the sheet bundle P, the deliverable of the press process and the crushing process is produced as the high-quality saddle-stitch booklet while the staple S is located in the central part of the thickness of the sheet bundle P as illustrated in FIG. 9B.

The finisher controlling portion 515 re-drives the motor M4 to restart the conveyance of the sheet bundle, and the pair of third folding rollers 812 (812*a*, 812*b*) discharges the sheet bundle to the folded bundle tray 840 (S14 of FIG. 14). A determination whether the final bundle is discharged is made, the processes from Step S3 are repeated when the final bundle is not discharged, and the job is ended when the final bundle is discharged (S15 of FIG. 14).

Figure 10:
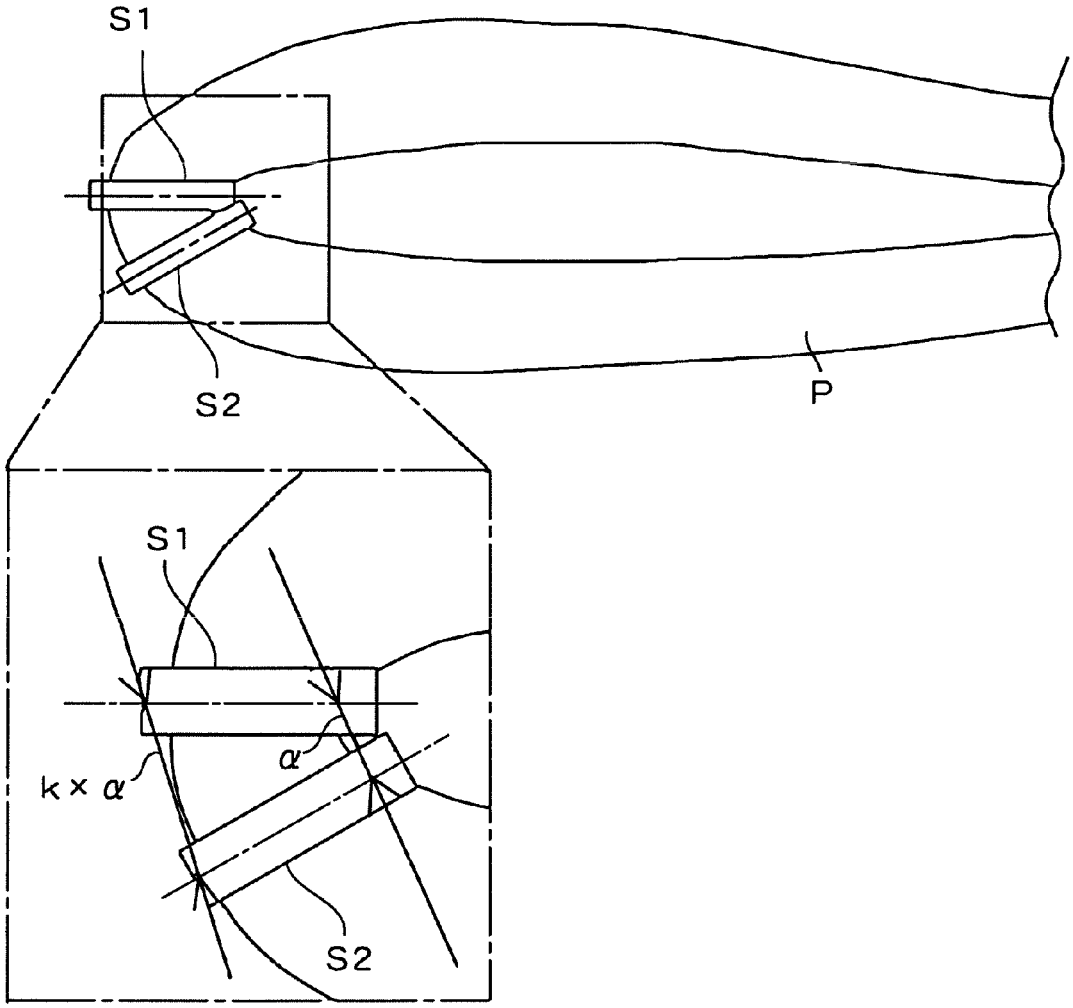
FIG. 10 is an explanatory view illustrating the action of the finisher of the first embodiment.
Figure 11:
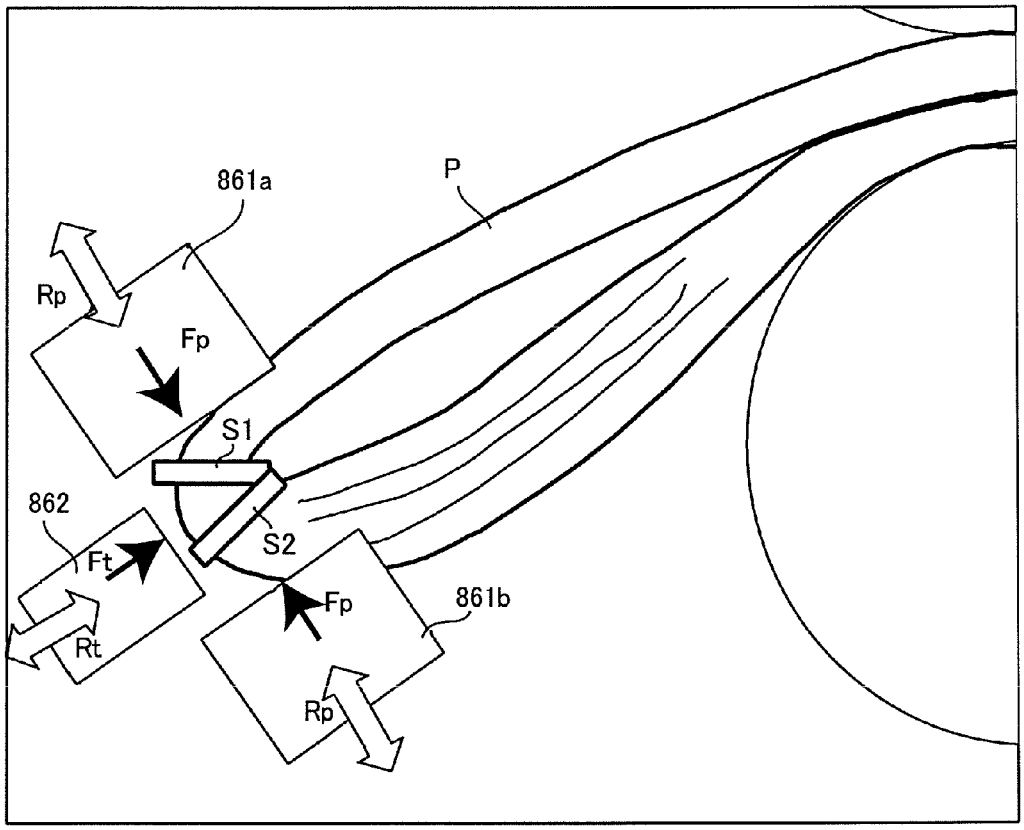
FIG. 11 is an explanatory view illustrating the action of the finisher of the first embodiment.
Figure 16:
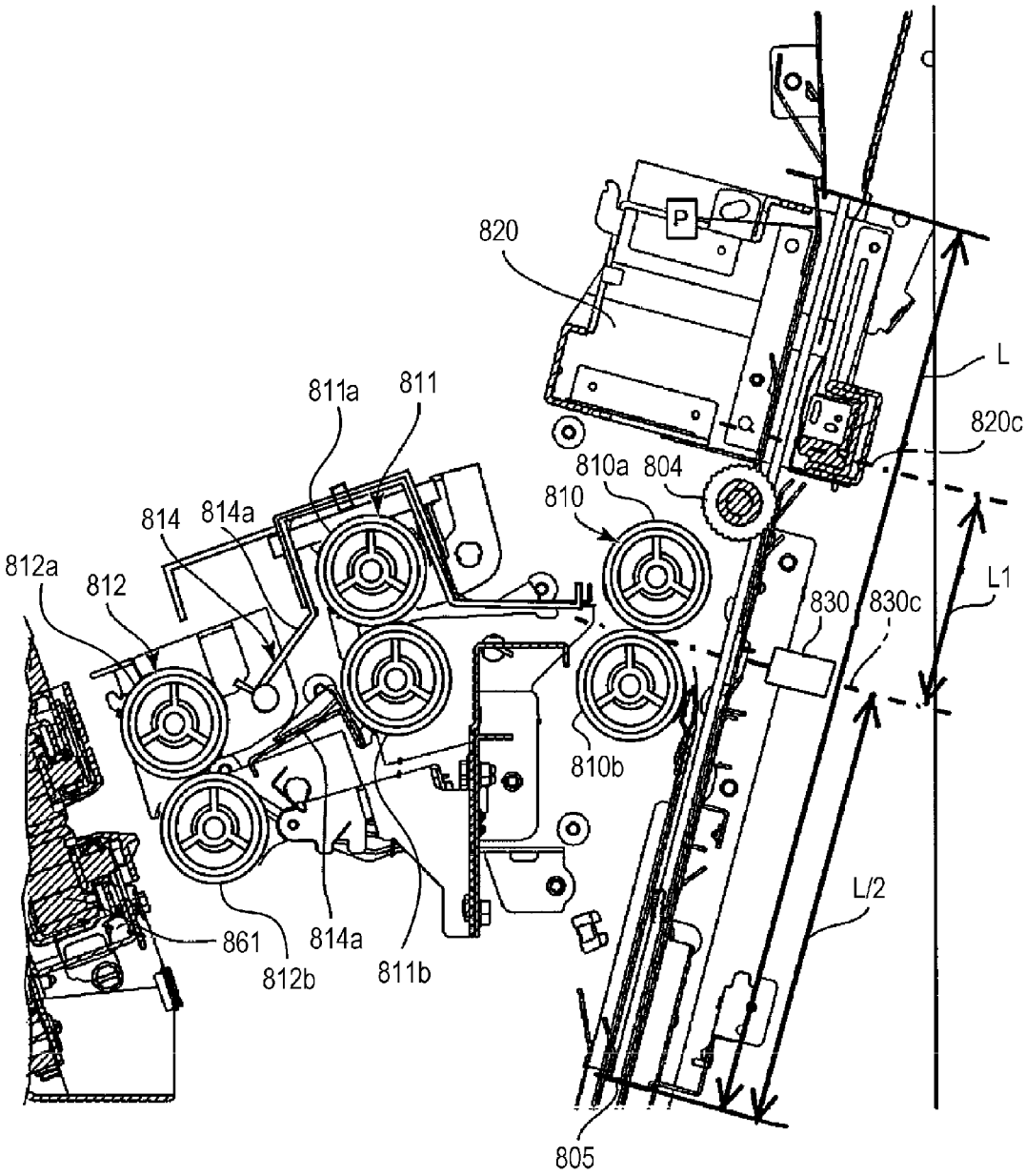
FIG. 16 PRIOR ART
FIG. 16 is an explanatory view illustrating action of a conventional finisher.
Figure 17:
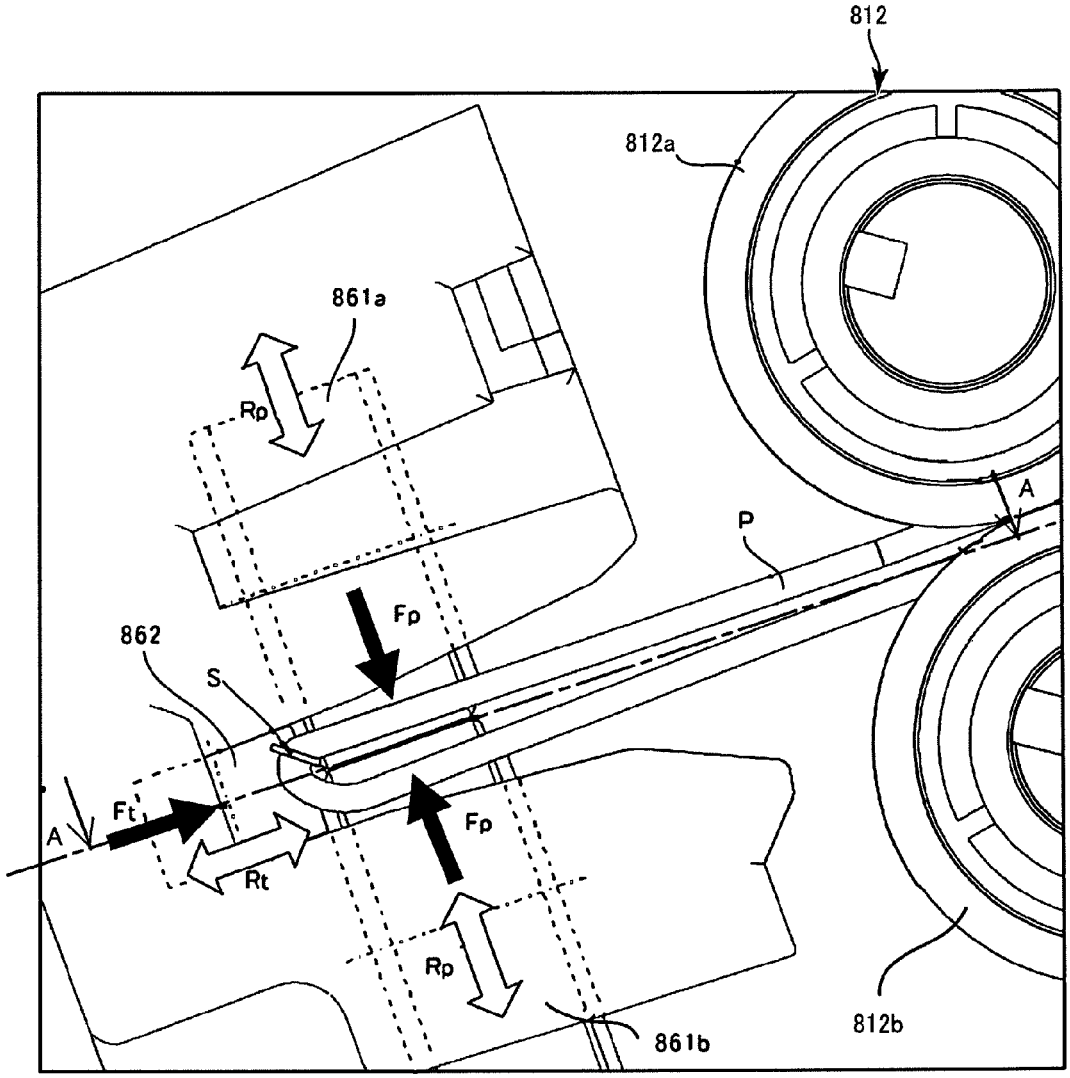
FIG. 17 PRIOR ART
FIG. 17 is an explanatory view illustrating the action of the conventional finisher.

The "displacement amount a" that is the feature will be described below. In FIG. 10, in both the regular and magnified view, symbol S1 indicates the staple position of the conventional technique just after the staple S exits from the nip of the pair of second folding rollers 811 and before reaching the upper guide 814*a* (FIG. 16) and symbol S2 indicates the staple position of an embodiment just after the staple S exits from the nip of the pair of second folding rollers 811 and before reaching the upper guide 814*a* (FIG. 8A). In FIG. 11, symbol S1 indicates the staple position of the conventional technique when the staple S reaches the pair of press rollers 861 and the pair of crushing rollers 862 of the fold-line press unit 860 (FIG. 17) and symbol S2 indicates the staple position of an embodiment when the staple S reaches the pair of press rollers 861 and the pair of crushing rollers 862 of the fold-line press unit 860 (FIG. 9A).

The leading end of the folded part of the sheet bundle P is oriented downward from the state illustrated in FIG. 10. Therefore, as illustrated in FIG. 11, the upper side of the sheet bundle P stretches while the lower side sags, and the staple S2 deviated by α is located on the central side.

That is, the staple S2 is deviated by k×α when viewed from the outside on which the quality is degraded. However, it is only necessary to deviate the inside of the sheet bundle by α because of a difference between the inner circumference and the outer circumference in the thickness of the sheet bundle P. The effect of k×α is obtained when the booklet is viewed from the outside even if the staple S2 is deviated by α, the inside is deviated by α when the booklet is opened. Therefore, the outside can largely be brought close to the center while the small deviation is generated on the inside.

Because a coefficient k changes according to the thickness of the sheet bundle P, more effectively the value of the "displacement amount α" is variably set such that a increases with increasing the number of sheets stacked on the accommodation guide 803, or a increases with increasing thickness of the sheet. The displacement amount α that is the predetermined distance can be set in each of the number of sheets of the sheet bundle P stacked on the accommodation guide 803 and/or each thickness, which allows the enhancement of the effect that the staple S2 deviated by α is brought close to the central side.

The displacement amount α that is the predetermined distance can be set in each of the number of sheets of the sheet bundle stacked on the accommodation guide 803 and/or each thickness, and the setting technique in each of the number of sheets and each thickness can be used by itself or a combined manner. Therefore, the accuracy that the staple S2 deviated by α is located on the central side can further be enhanced.

The following effect can be obtained by the stapling process performed below the center Pc of the sheet bundle P by α and the folding process of striking and folding the position of the center Pc of the sheet bundle P. The increase of the apparatus width is suppressed by the upper guide 814*a* that delivers the folded sheet bundle P, conveyed from the fold processing portion including the pair of first folding rollers 810 and the projecting member 830 while the folded end part is set to the leading position, to the fold-line press unit 860 while curved. Therefore, although the configuration is inexpensive, the end part process can be performed while the position of the staple is properly located. Even if the press process and the crushing process are performed to the sheet bundle P that is curved and conveyed to deform the shape of the leading end of the folded part, the staple position becomes the center after the press process and the crushing process, and therefore, the quality of the final deliverable can be improved.

In the first embodiment, the leading end of the sheet bundle P is oriented downward by the upper guide 814*a*, and the outside (upper side) of the sheet bundle P stretches by the conveying resistance from the upper guide 814*a* while the inside (lower side) sags. Therefore, as illustrated in FIG. 4, the staple position 820*c* of the staple S is deviated downward from the sheet bundle center Pc by α. However, when the conveying guide portion 814 guides the sheet bundle P such that the sheet bundle P is curved upward from the pair of first folding rollers 810, the sag of the sheet bundle P is generated on the upper side in the sheet bundle conveyance after the folding process. Therefore, the effect similar to that of the first embodiment can be obtained by upwardly deviating the staple position 820*c* of the staple S from the center Pc of the sheet bundle by α.

As described above, when the sheet bundle P is delivered by the upper guide 814*a* while curved, the application can implement the finisher 500 provided with the saddle-stitch bookbinding portion 800 having the inexpensive configuration without increasing the apparatus width. The staple S of the saddle-stitch bookbinding, which is conventionally deviated toward the end part of the thickness of the sheet bundle, can be located in the center of the leading end of the folded part to improve the quality of the final deliverable.

Second Embodiment

Figure 15A:
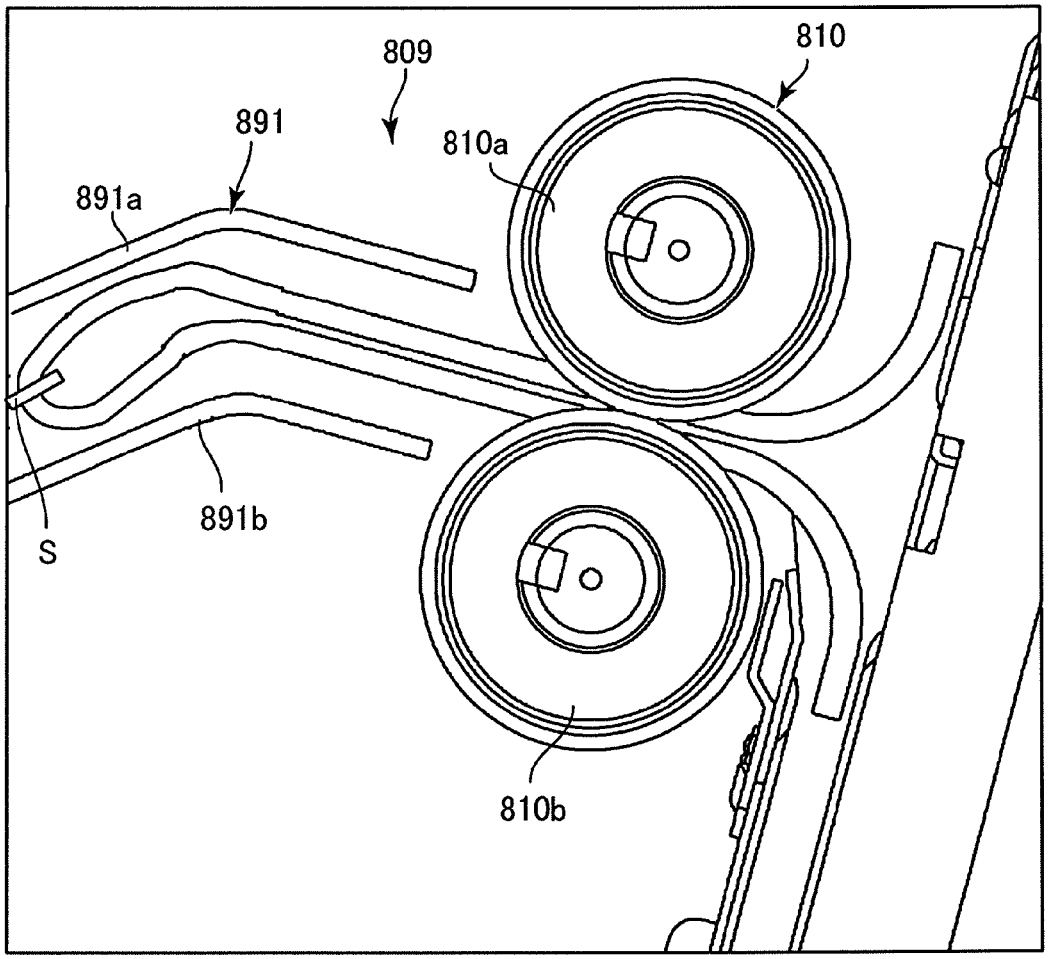
FIG. 15A is an explanatory view illustrating action of a finisher according to a second embodiment.
Figure 15B:
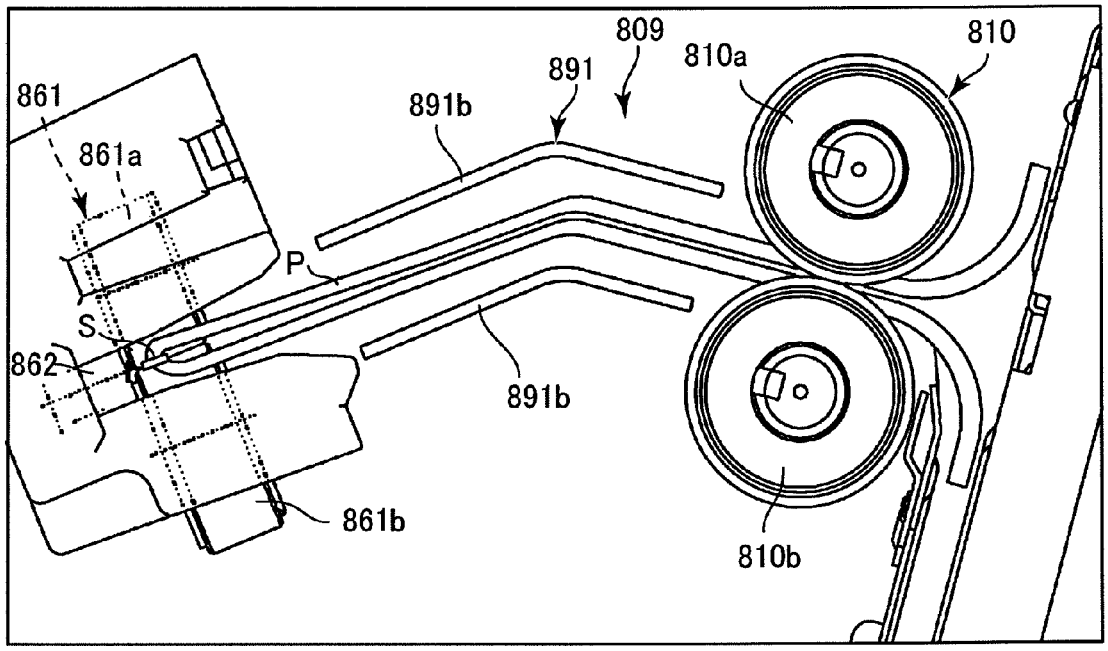
FIG. 15B is an explanatory view illustrating the action of the finisher of the second embodiment.

A finisher 500 according to a second embodiment will be described below with reference to FIGS. 15A and 15B.

The second embodiment differs from the first embodiment in that a conveying guide portion 891 is provided on the downstream side of the pair of first folding rollers 810 while the pair of second folding rollers 811, the conveying guide portion 814 and the pair of third folding rollers 812 are eliminated (see FIG. 8A). The conveying guide portion 891 includes an upper guide 891*a* and a lower guide 891*b*, which are the conveyance guide member, and differs from the nip of the pair of first folding rollers 810 in the orientation. In the second embodiment, the pair of press rollers 861 (861*a* and 861*b*) and the pair of crushing rollers 862 are disposed on downstream of the conveying guide portion 891. The conveying guide portion 891 is formed into the curved shape such that the sheet bundle, which is delivered while folded by the nip of the pair of first folding rollers 810, is conveyed to the fold-line press unit 860 while folded.

The control block diagram and the flowchart of the second embodiment are similar to those of the first embodiment. The sheet stopper 805 sequentially receives the sheet in which the image is formed, and the stapler 820 performs the stapling process. The second embodiment is similar to the first embodiment until the pair of first folding rollers 810 receives the sheets P projected by the projecting member 830 in order to fold the sheets P. Therefore, the description will not be repeated.

In the finisher 500 of the second embodiment, one of two surfaces of the sheet bundle P folded and conveyed by the pair of first folding rollers 810 is abutted on the upper guide 891*a* of the conveying guide portion 891 and guided to the lower side of the apparatus. At this point, similarly to the description of FIG. 8B, the conveying direction of the sheet bundle P is biased downward by the upper guide 891*a*, and the upper side of the sheet bundle P stretches by receiving the conveying resistance while the lower side sags, whereby the leading end of the sheet bundle P is oriented downward. Therefore, the position of the sheet stopper 805 is previously moved by a predetermined distance such that the stapling position where the stapler 820 performs the stapling closes to the area (lower surface of FIG. 15) on the side opposite to an area that becomes one (upper surface of FIG. 15) of two surfaces of the folded sheet bundle. Therefore, the staple S deviated downward is moved to the center as illustrated in FIG. 15A. As illustrated in FIG. 15B, the sheet bundle P is conveyed to the pair of press rollers 861 (861*a* and 861*b*) and the pair of crushing rollers 862, and the conveyance of the sheet bundle P is tentatively stopped.

At this point, the press process and the crushing process are performed. Therefore, in the deliverable after the press process and the crushing process, similarly to that of FIG. 9B, the staple S is located in the center of the thickness of the sheet bundle P, and the high-quality saddle-stitch booklet is produced.

In the second embodiment, not only the effect similar to that of the first embodiment is obtained, but also the effect that the configuration is simplified by replacing the pair of first folding rollers 810 while the pair of second folding rollers 811, the conveying guide portion 814 and the pair of third folding rollers 812 with the conveying guide portion 891 (891*a* and 891*b*) is obtained.

In the embodiments, the fold enhancing process of strengthening the fold line of the folded sheet bundle is described as the end part process. Alternatively, the squaring process of deforming the folded end part of the folded sheet bundle into a square shape may be used as the end part process.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2010-113295, filed May 17, 2010, and No. 2011-094648, filed Apr. 21, 2011, which are hereby incorporated by reference herein in their entirety.

What is claimed is:

1. A sheet processing apparatus comprising:

a sheet stacking portion on which a sheet is stacked;

a positioning member against which an end of the sheet conveyed to the sheet stacking portion is abutted for a positioning of the conveyed sheets to be made into a sheet bundle on the sheet stacking portion;

a staple processing portion which performs, at a stapling position on the sheet bundle, a stapling process to the sheet bundle stacked on the sheet stacking portion, wherein the positioning member is movable to adjust the stapling position on the sheet bundle;

a fold processing portion which, after the stapling process is performed, folds the sheet bundle in two to create a folded sheet bundle having a folded end part between a first surface and a second surface;

a conveyance guide member which guides the folded sheet bundle being conveyed from the fold processing portion with the folded end part as a leading end while the first surface of the folded sheet bundle slides against the conveyance guide member;

an end part processing portion which performs an end part process to the folded end part of the folded sheet bundle guided by the conveyance guide member; and a controlling portion which controls a movement of the positioning member such that, before the staple processing portion performs the stapling process, the stapling position is moved, by a predetermined distance from a center of the sheet bundle, to an area on the sheet bundle that is remote from the center of the sheet bundle and that will become the second surface by the movement of the positioning member, wherein the second surface is opposite to the first surface which slides against the conveyance guide member.

2. The sheet processing apparatus according to claim 1, wherein the fold processing portion includes a pair of folding rollers which folds the sheet bundle in two while the sheet bundle is sandwiched therebetween and a projecting member which projects the stapled sheet bundle stacked on the sheet stacking portion into the pair of folding rollers so that a sheet bundle center of the sheet bundle is led into the pair of folding rollers.

3. The sheet processing apparatus according to claim 1, wherein the predetermined distance is set according to the number of sheets of the sheet bundle stacked on the sheet stacking portion.

4. The sheet processing apparatus according to claim 1, wherein the predetermined distance is set according to a thickness of the sheet bundle stacked on the sheet stacking portion.

5. The sheet processing apparatus according to claim 1, wherein the end part process performed by the end part processing portion is a fold enhancing process of strengthening a fold line of the folded end part of the folded sheet bundle.

6. The sheet processing apparatus according to claim 1, wherein the end part process performed by the end part processing portion is a squaring process of deforming the folded end part of the folded sheet bundle into a square shape.

7. The sheet processing apparatus according to claim 1, wherein the conveyance guide member changes a direction of travel of the folded end part through moving contact with the sheet bundle and imparts a frictional resistance against the sheet bundle to cause a staple in the stapling position to move from a non lead position to a position where the staple now leads the sheet bundle as the sheet bundle travels to the end part processing portion.

8. An image forming apparatus comprising:

an image forming portion which forms an image in a sheet; and a sheet processing apparatus which performs bookbinding by folding a bundle of sheets in which images are formed, wherein the sheet processing apparatus includes:

a sheet stacking portion on which a sheet is stacked, a positioning member against which an end of the sheet conveyed to the sheet stacking portion is abutted for a positioning of the conveyed sheets to be made into a sheet bundle on the sheet stacking portion, a staple processing portion which performs, at a stapling position on the sheet bundle, a stapling process to the sheet bundle stacked on the sheet stacking portion, wherein the positioning member is movable to adjust the stapling position on the sheet bundle, a fold processing portion which, after the stapling process is performed, folds the sheet bundle in two to create a folded sheet bundle having a folded end part between a first surface and a second surface, a conveyance guide member which guides the folded sheet bundle being conveyed from the fold processing portion with the folded end part as a leading end while the first surface of the folded sheet bundle slides against the conveyance guide member, an end part processing portion which performs an end part process to the folded end part of the folded sheet bundle guided by the conveyance guide member, and a controlling portion which controls a movement of the positioning member such that, before the staple processing portion performs the stapling process, the stapling position is moved, by a predetermined distance from a center of the sheet bundle, to an area on the sheet bundle that is remote from the center of the sheet bundle and that will become the second surface by the movement of the positioning member, wherein the second surface is opposite to the first surface which slides against the conveyance guide member.

9. The image forming apparatus according to claim 8, wherein the fold processing portion includes a pair of folding rollers which folds the sheet bundle in two while the sheet bundle is sandwiched therebetween and a projecting member which projects the stapled sheet bundle stacked on the sheet stacking portion into the pair of folding rollers so that a sheet bundle center of the sheet bundle is led into the pair of folding rollers.

10. The image forming apparatus according to claim 8, wherein the predetermined distance is set according to the number of sheets of the sheet bundle stacked on the sheet stacking portion.

11. The image forming apparatus according to claim 8, wherein the predetermined distance is set according to a thickness of the sheet bundle stacked on the sheet stacking portion.

12. The image forming apparatus according to claim 8, further comprising an operation portion configured to set various functions concerning an image formation:

wherein the predetermined distance is configured to be set arbitrarily from the operation portion.

13. The image forming apparatus according to claim 8, wherein the end part process performed by the end part processing portion is a fold enhancing process of strengthening a fold line of the folded end part of the folded sheet bundle.

14. The image forming apparatus according to claim 8, wherein the end part process performed by the end part processing portion is a squaring process of deforming the folded end part of the folded sheet bundle into a square shape.

15. The image forming apparatus according to claim 8, wherein the conveyance guide member changes a direction of travel of the folded end part through moving contact with the sheet bundle and imparts a frictional resistance against the sheet bundle to cause a staple in the stapling position to move from a non lead position to a position where the staple now leads the sheet bundle as the sheet bundle travels to the end part processing portion.

* * * * *